US007784301B2

(12) United States Patent
Sasaki et al.

(10) Patent No.: US 7,784,301 B2
(45) Date of Patent: Aug. 31, 2010

(54) FOLDABLE HEAT INSULATING CONTAINER AND DISTRIBUTION METHOD

(75) Inventors: Masato Sasaki, Shiga (JP); Takao Sato, Shiga (JP); Haruyuki Ishio, Shiga (JP)

(73) Assignee: Panasonic Corporation, Osaka (JP)

( * ) Notice: Subject to any disclaimer, the term of this patent is extended or adjusted under 35 U.S.C. 154(b) by 914 days.

(21) Appl. No.: 10/586,917

(22) PCT Filed: Jan. 28, 2005

(86) PCT No.: PCT/JP2005/001633

§ 371 (c)(1),
(2), (4) Date: Jul. 24, 2006

(87) PCT Pub. No.: WO2005/073648

PCT Pub. Date: Aug. 11, 2005

(65) Prior Publication Data

US 2007/0157653 A1 Jul. 12, 2007

(30) Foreign Application Priority Data

Jan. 30, 2004 (JP) ..... 2004-022899
Feb. 3, 2004 (JP) ..... 2004-026433
Feb. 13, 2004 (JP) ..... 2004-036368

(51) Int. Cl.

| | |
|---|---|
| ***F25D 3/08*** | (2006.01) |
| ***B65D 3/00*** | (2006.01) |
| ***B65D 5/10*** | (2006.01) |
| ***B65D 5/24*** | (2006.01) |
| ***B65D 5/56*** | (2006.01) |
| ***B65D 5/62*** | (2006.01) |

(52) U.S. Cl. ..... 62/457.2; 229/103.11; 229/117; 229/186; 229/5.84

(58) Field of Classification Search ..... 62/457.2; 229/103.11, 117, 186, 5.84
See application file for complete search history.

(56) References Cited

U.S. PATENT DOCUMENTS 4,129,248 A * 12/1978 Casutt ..... 229/117
5,207,376 A * 5/1993 Cohen et al. ..... 229/186
5,441,170 A * 8/1995 Bane, III ..... 229/103.11

(Continued)

FOREIGN PATENT DOCUMENTS

JP 07-091594 4/1995

(Continued)

OTHER PUBLICATIONS

International Search Report for corresponding International PCT Application No. PCT/JP2005/001633 dated May 17, 2005.

*Primary Examiner*—Thomas E Denion
*Assistant Examiner*—Michael Carton
(74) *Attorney, Agent, or Firm*—RatnerPrestia

(57) ABSTRACT

Frozen products requiring cold insulation are housed inside of the cold-insulating container structured of a vacuum heat-insulating material, and the cold-insulating containers are loaded in a refrigerator vehicle, cold-insulating vehicle, or room-temperature vehicle other than a freezer vehicle for delivery. Each of the peripheral walls, lids, and bottom faces of this container is made of a sheet material enveloping the vacuum heat-insulating material therein. In each of the peripheral walls adjacent to the peripheral walls connected to the lids, the vacuum heat-insulating material is divided along folding line so as to be foldable.

23 Claims, 8 Drawing Sheets

U.S. PATENT DOCUMENTS

| | | | | |
|---|---|---|---|---|
| 5,899,088 | A * | 5/1999 | Purdum | 62/371 |
| 5,918,478 | A * | 7/1999 | Bostic et al. | 62/371 |
| 6,155,479 | A * | 12/2000 | Wellner et al. | 229/117.08 |
| 6,519,968 | B1 * | 2/2003 | Konarski | 62/371 |
| 7,214,402 | B2 * | 5/2007 | Burdick | 426/592 |
| 2002/0134822 | A1 * | 9/2002 | Mills | 229/103.3 |
| 2002/0134827 | A1 * | 9/2002 | Sinclair et al. | 229/240 |
| 2004/0118854 | A1 * | 6/2004 | Kutun | 220/507 |
| 2004/0140345 | A1 * | 7/2004 | Kao | 229/117.07 |

FOREIGN PATENT DOCUMENTS

| | | |
|---|---|---|
| JP | 08-305774 | 11/1996 |
| JP | 09-165073 | 6/1997 |
| JP | 2583450 | 10/1998 |
| JP | 2003-112786 | 4/2003 |
| JP | 2003-182777 | 7/2003 |
| JP | 2003-205939 | 7/2003 |
| JP | 2003-314951 | 11/2003 |
| JP | 2004-315021 | 11/2004 |

* cited by examiner

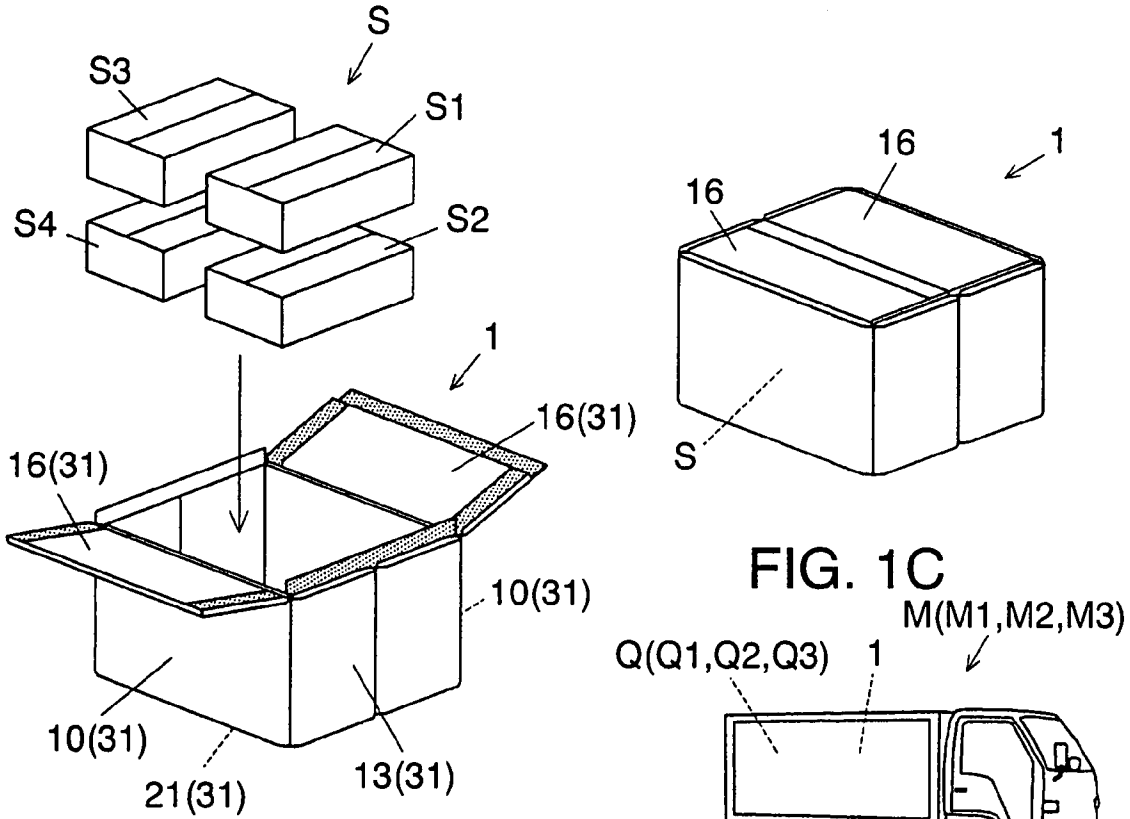
FIG. 1A
FIG. 1B
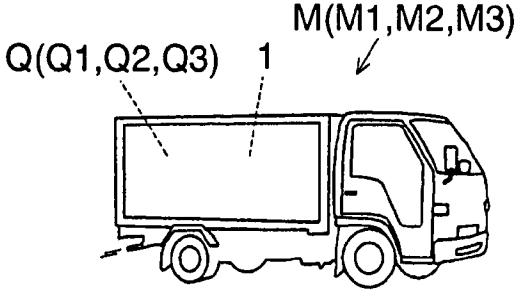
FIG. 1C
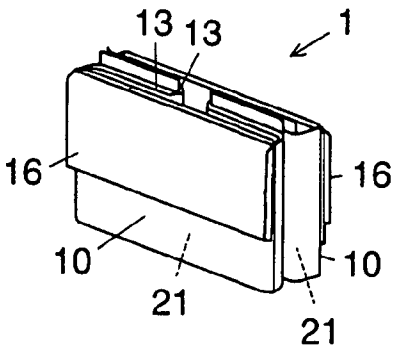
FIG. 1D

FOLDABLE HEAT INSULATING CONTAINER AND DISTRIBUTION METHOD

This Application is a U.S. National Phase Application of PCT International Application No. PCT/JP2005/001633 Filed Jan. 28, 2005.

TECHNICAL FIELD

The present invention relates to a frozen product delivery method, and particularly to a small cargo delivery method of delivering frozen products from a wholesaler to a plurality of markets.

The present invention also relates to a container mainly for cold-insulating transportation, i.e. a cold-insulating container collapsible not in use.

BACKGROUND ART

In recent years, the number of deliveries of frozen products requiring cold insulation has been increasing with popularization of frozen food. Generally, such deliveries are classified into a bulk delivery from a factory of frozen products to wholesalers (distribution centers), and a small cargo delivery from a wholesaler to supermarkets or convenience stores.

In the small cargo delivery from a wholesaler to supermarkets or convenience stores, frozen products are classified and housed in cold-insulating containers for each destination.

Many of conventional cold-insulating containers employ a single heat-insulating material, such as expanded polystyrene and rigid urethane foam, and zippers or hook-and-loop fasteners for opening and closing the lids thereof. However, for such a cold-insulating container, the heat-insulating material thereof is excellent in initial thermal conductivity and poor in cold-insulating performance. Additionally, the cold-insulating container is likely to be bulky in transportation and storage after delivery. To address this problem, a collapsible cold-insulating vessel having improved cold-insulating performance has been developed. Such a technique is disclosed in Japanese Patent Unexamined Publication No. 2003-112786.

FIG. 11 is a perspective view showing a cold-insulating vessel disclosed in Japanese Patent Unexamined Publication No. 2003-112786. Heat-insulating vessel 100 disclosed in Japanese Patent Unexamined Publication No. 2003-112786 is made of flexible outer bag 101 and inner bag 103, and vacuum heat-insulating panels 102. For outer bag 101, five faces, i.e. a bottom face and four side faces thereof are sewn into substantially a rectangular parallelepiped, and belt 105 is placed from a side face over the bottom face to the opposite side face. Additionally, onto one of upper sides of outer bag 101, lid 104 is sewn. On the bottom of outer bag 101 and inside of lid 104, heat-insulating panels (not shown) are previously provided.

Prior to use, four heat-insulating panels 102 are inserted along the four side faces of outer bag 101, and hook-and-loop fasteners 111 on respective heat-insulating panels 102 are engaged with hook-and-loop fasteners 110 on outer bag 101. Further, inner bag 103 is placed in outer bag 101 having heat-insulating panels 102 attached thereto, and hook-and-loop fasteners 112 are engaged with hook-and-loop fasteners 111 on respective heat-insulating panels 102 for assembly.

Frozen products or the like are housed in inner bag 103 of assembled cold-insulating vessel 100, lid 104 is placed over outer bag 101, and hook-and-loop fasteners 106 and 108 on lid 104 are engaged with hook-and-loop fasteners 107 and 109 on outer bag 101, respectively. Thus, the cold-insulating vessel is closed for delivery.

Cold-insulating vessel 100 disclosed in Japanese Patent Unexamined Publication No. 2003-112786 is collapsible not in use. In other words, not in use, inner bag 103 and four heat-insulating panels 102 are removed from outer bag 101, in a manner reverse to assembly, and removed heat-insulating panels 102 and collapsed inner bag 103 are housed inside of outer bag 101. Then, while outer bag 101 is being collapsed, lid 104 is placed on the bottom so as to face thereto. Belt 113 is placed over both ends of belts 105 to collapse the vessel.

In other words, cold-insulating vessel 100 disclosed in Japanese Patent Unexamined Publication No. 2003-112786 is made available for delivery as a box having heat-insulating property in use. Not in use, the vessel can be collapsed, delivered, and stored in a not bulky shape.

Delivery vehicles for use in delivery of foods or the like are roughly classified into freezer vehicles, refrigerator vehicles, cold-insulating vehicles, and room-temperature vehicles.

Among delivery vehicles, some are freezer and cold-insulating vehicles including both freezer and refrigerator in one vehicle, and some are those capable of switching the temperature of the one storage for a freezer and refrigerator so as to deliver all the products, from frozen foods to those stored at room temperature.

However, a vehicle having such a complex function is not typical. In delivery of frozen foods, it is common to place frozen products in a cold-insulating vessel with a cold-storage agent and deliver the cold-insulating vessel using a freezer vehicle.

SUMMARY OF THE INVENTION

A delivery method includes: placing frozen products requiring cold insulation inside of a cold-insulating container made of a vacuum heat-insulation material; and loading the cold-insulating container in a refrigerator vehicle, cold-insulating vehicle, or room-temperature vehicle other than a freezer vehicle.

The cold-insulating container includes: four peripheral walls; a bottom face; and openable and closable lid. Each of the members is formed of a sheet material enveloping a planar vacuum heat insulating material therein. The container is collapsible, with respective members forming a box in use, and each member overlapping with one another not in use.

BRIEF DESCRIPTION OF THE DRAWINGS

FIGS. 1A, 1B, 1C, and 1D are explanatory views illustrating a method of delivering frozen products in accordance with an exemplary embodiment of the present invention.

DETAILED DESCRIPTION OF PREFERRED EMBODIMENTS

Figure 2A:
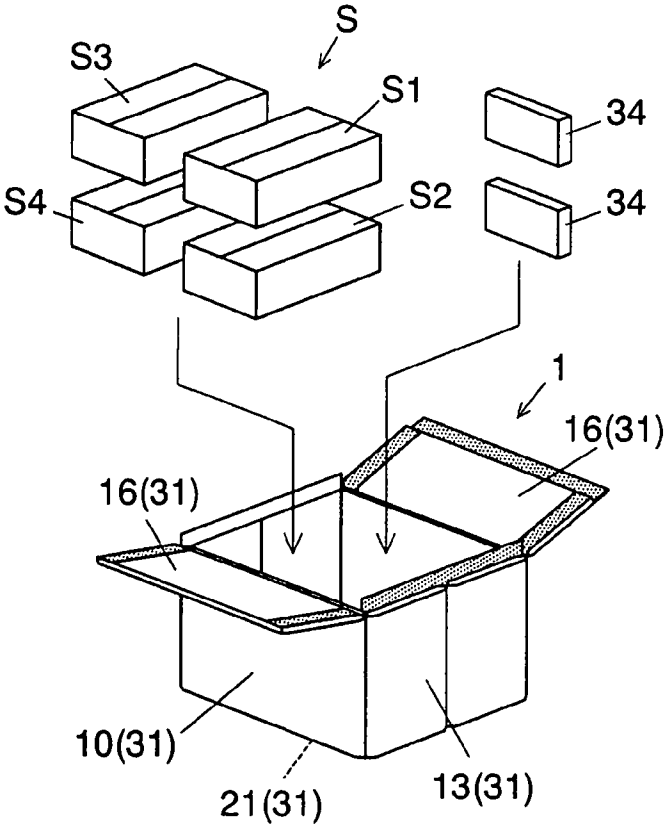
FIGS. 2A, 2B, 2C, and 2D are explanatory views illustrating a method of delivering frozen products in accordance with an exemplary embodiment of the present invention.

As described above, when frozen products are delivered, the products are housed in a cold-insulating container with a cold storage agent inserted therein, and a freezer vehicle is used for delivery. Thus, even a small amount of frozen products for delivery occupies one freezer vehicle. This is a factor in inhibiting cost saving.

In other words, because a freezer vehicle requires control at low temperatures, delivery cost thereof is more expensive than those of a refrigerator vehicle, cold-insulating vehicle, and room-temperature vehicle. Moreover, using the above vehicle having a complex function relatively increases the delivery cost. For these reasons, when one freezer vehicle is occupied for delivery of a small amount of frozen products, the delivery cost thereof is likely to increase.

Even when frozen products and refrigerated products are delivered to the same destination, different cold-insulating temperatures inhibit those products to be delivered in gross, and dedicated delivery vehicles are required for each kind of products. This increases the number of vehicles required for delivery and also the delivery cost thereof. Improvements are desired also to protect environment.

Further, in relation to the delivery of frozen products, frozen products are delivered to a destination with the frozen products housed in cold-insulating containers, and the used cold-insulating containers are collected at the time of next delivery, in some case.

When cold-insulating vessel 100 disclosed in Japanese Patent Unexamined Publication No. 2003-112786 is used in this case, each cold-insulating vessel can be collapsed for storage after frozen products are taken out of the cold-insulating vessel, in operations at the destination, and thus takes only a small space for storage. However, cold-insulating vessel 100 disclosed in Japanese Patent Unexamined Publication No. 2003-112786 takes many labor hours to collapse as described above. In the course of events, the vessels are often left in a not collapsed configuration, and thus cannot exert advantage of being collapsible.

The present invention is proposed to address the above situations, aims to re-examine the conventional method of delivering frozen products, and provide an economic method of delivering frozen products with improved cost saving and working efficiency while maintaining the quality of the frozen products.

To attain the objective, in the present invention, frozen products requiring cold insulation are housed inside of a cold-insulating container made of a vacuum heat-insulating material, and the cold-insulating containers are loaded in a refrigerator vehicle, cold-insulating vehicle, and room-temperature vehicle other than a freezer vehicle for delivery.

Now, the cold-insulating vehicle is referred to a vehicle including a storage of which side faces, ceiling, floor, and doors are made of heat-insulating material to thermally shield the inside of the storage from the outside. The freezer vehicle is referred to a vehicle that exclusively delivers frozen food, such as frozen meat and ice cream, while maintaining the quality thereof, and that incorporates, in the cold-insulating vehicle, a freezer capable of controlling the temperature thereof in the range of approx. −25 to −10° C. (inclusive). The refrigerator vehicle is referred to a vehicle that exclusively delivers chilled food, such as fresh food and dairy products, or refrigerated food, such as fresh vegetable and cakes, while maintaining the quality thereof, and that incorporates, in the cold-insulating vehicle, refrigerating installation capable of controlling the temperature thereof in the range of approx. 0 to +20° C. (inclusive). So-called "chill vehicles" are included in the category of refrigerator vehicles. The room-temperature vehicle is referred to a vehicle including an ordinary storage without heat-insulating property.

The present invention allows frozen products to be delivered by a delivery vehicle other than a freezer vehicle, and thus can provide a method capable of delivering frozen products with improved delivery cost and efficiency, and contributing to environmental protection.

On the other hand, cold-insulating vessel 100 disclosed in Japanese Patent Unexamined Publication No. 2003-112786 takes many labor hours for assembly prior to use and for collapse not in use.

For this reason, when a large number of cold-insulating vessels 100 are used for delivery, assembling operation prior to the delivery and collapsing operation after the delivery take many labor hours. This is a factor in decreasing the working efficiency.

Additionally, because cold-insulating vessel 100 disclosed in Japanese Patent Unexamined Publication No. 2003-112786 includes detachable heat-insulating panels 102 and inner bag 103, some of constituent members are easily missing.

Other than cold-insulating vessel 100 disclosed in Japanese Patent Unexamined Publication No. 2003-112786, many collapsible cold-insulating containers are proposed. However, many of those easily assembled and collapsed have poor cold-insulating performance. Thus, it is expected to develop cold-insulating containers that have excellent cold-insulating performance and can be assembled and collapsed quickly.

The present invention is proposed to address the above circumstances, and aims to provide a cold-insulating container that has an excellent cold-insulating performance and can be assembled and collapsed in a short period of time.

To attain the above objective, a collapsible cold-insulating container of the present invention includes: four peripheral walls, a bottom face, and an openable and closable lid. Each of the members is formed of a sheet material enveloping a planar vacuum heat-insulating material therein. The cold-insulating container is collapsible, with respective members forming a box in use, and respective members overlapping with one another not in use.

In the present invention, the use of a vacuum heat-insulating material can provide excellent cold-insulating performance. Each of the peripheral walls, bottom face, and lid is integrally formed of a sheet material enveloping a planar vacuum heat-insulating material therein. For this reason, the cold-insulating container can be assembled and collapsed in a short period of time, without the need of taking labor hours to remove the vacuum heat-insulating material.

A collapsible cold-insulating container of the present invention includes: four peripheral walls connected into a square shape so as to be foldable one another; two lids connected to two opposed ones of the peripheral walls along the upper side edges thereof so as to be foldable; two bottom faces connected to the two peripheral walls connected to the lids, along the lower side edges thereof so as to be foldable. Each of the peripheral walls, lids, and bottom faces is formed of a sheet material enveloping a planar vacuum heat-insulating material therein. In each of the two peripheral walls adjacent to the peripheral walls connected to the lids and bottom faces, the vacuum heat-insulating material is divided along a folding line extending in the direction of the height thereof in substantially a central part so as to be foldable. The container has a collapsible structure. In use, the two lids and bottom faces are turned into a closed position for engagement to form a box. Not in use, the engagement of the lids and bottom faces is released, the bottom faces are folded inwardly or outwardly of the peripheral walls, and the lids are folded in the direction opposite to that of the bottom faces. Then, while the foldable peripheral walls are folded inwardly along the folding lines, the adjacent peripheral walls are brought closer to each other so that the lids, peripheral walls, and bottom faces overlap with one another.

In the present invention, because each of the four peripheral walls, two lids, and two bottom faces is formed of a sheet material enveloping a vacuum heat-insulating material therein, excellent cold-insulating performance is exhibited.

In the present invention, all the peripheral walls, lids, and bottom faces are connected so as to be foldable one another. The cold-insulating container can be assembled into a box configuration or collapsed into an overlapping configuration, with all the members connecting to one another. This structure eliminates the labor hours taken to attach or detach another member to or from the cold-insulating container, thus considerably reducing the labor hours taken for assembly and collapse. Because respective members are connecting to one another, there is no possibility of missing any member.

In the present invention, because each face is formed of a sheet material enveloping a vacuum heat-insulating material therein, each face has a high strength and rigidity. This structure improves the strength and rigidity of the assembled box. When the cold-insulating container is collapsed, the foldable peripheral walls are folded inwardly along the folding lines. Thus, the cold-insulating container can be collapsed into a downsized shape without the foldable peripheral walls protruding from the adjacent peripheral walls, and is convenient for collection and storage.

The present invention can provide a collapsible cold-insulating container that has excellent cold-insulating performance and is collapsible not in use to facilitate collection and storage thereof.

The present invention can also provide a collapsible cold-insulating container that can easily be assembled and exhibits excellent cold-insulating performance in use, and can easily be collapsed in a short period of time for collection and storage not in use.

The present invention provides a frozen product delivery method of housing frozen products requiring cold insulation inside of cold-insulating containers each made of a vacuum heat-insulating material, and loading the cold-insulating containers in a refrigerator vehicle, cold-insulating vehicle, or room-temperature vehicle other than a freezer vehicle for delivery.

In this invention, the use of a vacuum heat-insulating material can provide a considerably excellent heat-insulating property of a cold-insulating container. Therefore, housing frozen products in the cold-insulating container to block the heat transfer to the surroundings thereof can limit temperature fluctuations of the frozen products within a predetermined range, in a predetermined period of time.

The present invention takes advantage of such characteristics of the cold-insulating container, and allows delivery of frozen products using a refrigerator vehicle, cold-insulating vehicle, or room-temperature vehicle other than a freezer vehicle.

This method eliminates the need of a freezer vehicle in delivery of frozen products; thus reducing the delivery cost.

In addition, because frozen products housed in cold-insulating containers are delivered using a refrigerator vehicle, cold-insulating vehicle, or room-temperature vehicle other than a freezer vehicle, frozen products can also be delivered at the same time in addition to delivery products to originally be loaded in the vehicle used for delivery. In other words, in delivery using a refrigerator vehicle, frozen products can also be loaded in addition to refrigerated products to originally be loaded in the refrigerator vehicle at the same time for delivery. In delivery using a cold-insulating vehicle, frozen products can also be loaded in addition to cold-insulated products to originally be loaded in the cold-insulating vehicle at the same time for delivery. In delivery using a room-temperature vehicle, frozen products can also be loaded in addition to products to originally be loaded in the room-temperature vehicle at the same time for delivery.

This delivery method allows frozen products and any product other than frozen products to be delivered in gross using one delivery vehicle to the same destination; thereby considerably increasing the delivery efficiency.

Additionally, this delivery method allows frozen products and any product other than frozen products to be delivered in gross using one delivery vehicle; thereby eliminating the need of a freezer vehicle for delivering frozen products only. The reduction in the number of vehicles necessary for delivery can contribute to environmental protection.

In the present invention, the periods of time in which frozen products housed in cold-insulating containers can be delivered with the quality (temperature) thereof maintained vary with the percentages of housed frozen products and the kinds of delivery vehicles. In other words, the periods of time in which frozen products housed in cold-insulating containers can be delivered with the quality (temperature) thereof maintained depend on the amount of frozen products housed in cold-insulating containers and the kinds of delivery vehicles, i.e. a refrigerator vehicle, cold-insulating vehicle, and room-temperature vehicle.

Therefore, tests are previously conducted on each kind of delivery vehicles to obtain the periods of time in which frozen products can be delivered with the quality (temperature) thereof maintained, with respect to the percentages thereof housed in cold-insulating containers. This allows easy selection of a delivery vehicle according to the time taken for delivery, and prevents deterioration of the quality of the frozen food.

Recently, some freezer vehicles and refrigerator vehicles employ automatic idling-stop. In some cases, a driver carries out automatic idling stop strictly on the driver's own judgment. For a vehicle employing automatic idling stop, when the vehicle comes to a halt and the transmission thereof is changed to the neutral position, for example, the engine thereof automatically halts. When the clutch is stepped on to start the vehicle, the engine automatically starts.

However, in a freezer vehicle or refrigerator vehicle employing such idling stop, the halt of the engine stops driving the freezer. For this reason, the temperature inside of the freezer or refrigerator is likely to fluctuate. When frozen products are housed in cold-insulating containers with a low heat-insulating property for delivery, the employment of idling stop can affect the quality thereof even with the use of a freezer vehicle.

However, for the present invention, the use of a vacuum heat-insulating material for the cold-insulating container considerably increases the heat-insulating property thereof. This allows delivery of frozen products housed in the cold-insulating containers, which has conventionally been made by a freezer vehicle, using a vehicle other than a freezer vehicle. Therefore, the temperature fluctuations inside of a refrigerator caused by idling stop give less influence on the temperature fluctuations inside of the cold-insulating containers, and the influence on the frozen products can be prevented.

In the present invention, the vacuum heat-insulating material is structured so that a core material made by compression-molding fiber materials is covered with a gas-barrier jacket material, and the inside covered with the jacket material is depressurized for vacuum encapsulation, in the above method of delivering frozen products.

In the present invention, the heat-insulating property is considerably higher than that of a conventional heat-insulating material. For this reason, even the use of a thin vacuum heat-insulating material can ensure necessary cold-insulating performance. Thus, a cold-insulating container having the same heat-insulating property and internal capacity can be made into a more downsized shape than that made by another heat-insulating material having a low heat-insulating property.

In the present invention, the vacuum heat-insulating material is structured to have a thickness ranging from 2 to 20 mm (inclusive), in the above method of delivering frozen products.

When the thickness of the vacuum heat-insulating material is up to 2 mm, the rigidity and strength thereof are low even with necessary cold-insulating performance obtained, and damage is likely to be caused by external force. When the thickness of the vacuum heat-insulating material exceeds 20 mm, the cold-insulating performance thereof increases unnecessarily. This is a factor in inhibiting the cold-insulating container from being more downsized and cost-saving. Thus, vacuum heat-insulating materials having a thickness ranging from 2 to 20 mm are preferable. In consideration of cold-insulating performance, downsizing, and cost saving, those having a thickness ranging from 3 to 5 mm (inclusive) are the most preferable.

In the present invention, the vacuum heat-insulating material is structured so that the initial thermal conductivity thereof is up to 0.01 W/mK, in the above method of delivering frozen products.

In the present invention, the use of a vacuum heat-insulating material having an (initial) thermal conductivity in the above range can considerably increase the heat-insulating property. This property can reduce the thickness of the heat-insulating material, and downsize the cold-insulating container while ensuring necessary cold-insulating performance.

A vacuum heat-insulating material having an (initial) thermal conductivity up to 0.01 W/mK is preferable. When improvements in cold-insulating performance and reduction in thickness are intended, those having a thermal conductivity up to 0.006 W/mK are more preferable, and those having a thermal conductivity up to 0.003 W/mK are the most preferable.

The present invention is structured so that the cold-insulating container is capable of housing frozen products at a predetermined percentage or more with respect to the internal capacity thereof, and maintaining the average inside temperature thereof up to 0° C. for two hours or longer, in the above method of delivering frozen products.

As described above, the periods of time in which frozen products housed in the cold-insulating container can be delivered with the quality thereof maintained vary with the kinds of delivery vehicles. The amount of frozen products to be housed in a cold-insulating container also gives influence on the inside temperature of the cold-insulating container.

In the present invention, previously obtaining the percentage of housed frozen products that can maintain the average inside temperature of the cold-insulating container up to 0° C. continuously for two hours or longer allows selection of the kinds of delivery vehicles suitable for the amount of frozen products to be delivered with reference to the data.

Thus, a short-time delivery, for approx. two hours, can be performed without using cold-storage agent and deteriorating the quality of the frozen products.

The present invention is structured so that an amount of cold-storage agent corresponding with the time taken for delivery is housed in the cold-insulating container, in the above method of delivering frozen products.

Because the cold-insulating container used for the present invention is made of a vacuum heat-insulating material, the container has a considerably high heat-insulating property. Therefore, as described above, the quality of the frozen products can be maintained without any cold-storage agent for a short period of time. However, over a long period of time taken for delivery, the inside temperature of the cold-insulating container cannot be maintained at a predetermined temperature or lower.

In the present invention, because a cold-storage agent is placed in the cold-insulating container in an amount according to the time taken for delivery, the inside temperature of the cold-insulating container can be maintained at a predetermined temperature or lower so that the quality of frozen products is maintained.

Tests are conducted on each kind of delivery vehicles to obtain the delivery time periods with respect to the amount of cold-storage agent to be housed. Thus, the amount of the cold-storage agent to be housed can immediately be determined according to the period of time taken for delivery, with reference to the data. This allows selection of the kinds of vehicles to be used for delivery, placement of an amount of the cold-storage agent corresponding with the period of time taken for delivery, and delivery of frozen products without deteriorating the quality thereof.

The present invention is structured so that a cold-storage agent having a melting point ranging from −27 to −18° C. (inclusive) is housed in the cold-insulating container, in the above method of delivering frozen products.

In wholesalers or distribution centers where small cargo deliveries of frozen products are performed using cold-insulating containers, the freezers thereof are generally controlled at temperatures ranging from −30 to −22° C. (inclusive).

In the present invention, if only cold-storage agents having a melting point equal to or higher than a temperature set for a freezer according to the temperature settings thereof are stored in the freezer, among those having melting points ranging from −27 to −18° C., the phase thereof can be changed to a solid. Thus, the cold-storage agents can be housed in the cold-insulating containers immediately before delivery available for cold insulation.

The present invention is structured so that the cold-insulating container is capable of housing at least 1 kg of cold-storage agent per internal capacity of 50 l, and maintaining the average inside temperature thereof up to 0° C. for 10 hours or longer.

Now, a refrigerator vehicle for delivery includes a limiter device having a speed of 90 km/h to prevent accidents. For this reason, when products are delivered from a frozen product factory to a wholesaler via an express way, the time taken for delivery is longer than that of a case without a limiter device. For example, when products are delivered between Kyushu and Tokyo via an express way, a vehicle with a limiter device takes three hours longer than that without a limiter device. Therefore, when a long-distance delivery is to be made between Kyushu and Tokyo using a refrigerator vehicle, approx. 10 hours are necessary.

For this reason, for a cold-insulating container having a low heat-insulating property, the amount of cold-storage agent is unnecessarily increased. The increased amount of cold-storage agent occupies the space for storing frozen products.

In the present invention, the use of a vacuum heat-insulating material for the cold-insulating container considerably increases a heat-insulating property thereof. Thus, the heat-insulating property thereof is accordingly set by adjusting the structure or thickness of the vacuum heat-insulating material so that at least 1 kg of cold-storage agent per internal capacity of 50 l is housed and the average inside temperature can be maintained continuously for 10 hours or longer.

In this manner, if only a small amount of cold storage agent is housed inside of the cold-insulating container, a long-time delivery can be made using a vehicle other than a freezer vehicle without affecting the quality of frozen products.

The present invention is structured so that the cold-insulating container has an internal capacity of 70 l or more, in the above method of delivering frozen products.

In the present invention, setting an internal capacity according to the amount of frozen products sorted for destinations of small cargo deliveries allows storage of frozen products for one destination in one cold-insulating container in gross; thus increasing efficiency of the delivery operation.

It is preferable that the internal capacity of the cold-insulating container range from 70 to 100 l (inclusive). For an internal capacity up to 70 l, the small internal capacity increases the number of cold-insulating containers for one destination; thus making the storage and delivery operations more troublesome. For an internal capacity exceeding 100 l, the weight of the cold-insulating container when being filled with frozen products is too heavy; thus decreasing the delivery efficiency. For these reasons, it is most preferable that the internal capacity of a cold-insulating container range from 70 to 100 l.

The present invention is structured so that a protective case for housing the cold-insulating containers is provided and products are delivered with the cold-insulating containers housed in the protective case.

Structuring the cold-insulating container using a vacuum heat-insulating material with a predetermined strength and rigidity can provide the strength and rigidity of a single body of the cold-insulating container. However, excessive external force exerted on the cold-insulating container during delivery can damage the heat-insulating material, in some cases. When the cold-insulating containers are piled up in a plurality of layers, strength thereof is insufficient.

In the present invention, housing the cold-insulating container in the protective case can prevent external force exerted directly on the cold-insulating container and thus damage to the cold-insulating container.

Even when the cold-insulating containers are housed in the protective cases and piled up in a plurality of layers, the protective cases support the weight of the cold-insulating containers on the upper side and the load is not exerted directly onto the cold-insulating containers. This structure can prevent damage to the cold-insulating containers. In this case, piling up the protective cases to form an engageable structure enables the loading operation more efficient.

A protective case formed of a synthetic resin molded form has a light weight, and sufficient strength and rigidity. Additionally, forming the protective case into a collapsible structure facilitates collection thereof after delivery; thus reducing the space for storage.

In the present invention, the cold-insulating container has the following structure, in the above method of delivering frozen products. The cold-insulating container includes: four peripheral walls, a bottom face, and an openable and closable lid. Each of the members is formed of a sheet material enveloping a planar vacuum heat-insulating material therein. The cold-insulating container is collapsible with respective members forming a box in use, and respective members overlapping with one another not in use.

In the present invention, each of the peripheral walls, bottom face, and lid are integrally formed of a sheet material enveloping a planar vacuum heat-insulating material therein. Unlike a conventional heat-insulating container, this heat-insulating container can be assembled and collapsed for a short period of time without labor hours taken to remove one of members, such as a vacuum heat-insulating material. This structure allows efficient delivery operation and facilitates delivery and storage after use.

When the present invention is combined with the above protective case, a plurality of cold-insulating containers collapsed not in use can be housed in the protective case. This structure allows efficient collection and storage of the cold-insulating containers.

In the present invention, the collapsible cold-insulating container has the following structure in the above method of delivering frozen products. The cold-insulating container includes: four peripheral walls connected into a square shape so as to be foldable one another; two lids connected to two opposed ones of the peripheral walls along the upper side edges thereof so as to be foldable; two bottom faces that are connected to the two peripheral walls connected to the lids, along the lower side edges thereof, so as to be foldable. Each of the peripheral walls, lids, and bottom faces is formed of a sheet material enveloping a planar vacuum heat-insulating material therein. In each of the two peripheral walls adjacent to the peripheral walls connected to the lids and bottom faces, the vacuum heat-insulating material is divided along a folding line extending in the direction of the height thereof in substantially a central part, so as to be foldable. The container has a collapsible structure. In use, the two lids and bottom faces are turned into a closed position for engagement to form a box. Not in use, the engagement of the lids and bottom faces is released, the bottom faces are folded inwardly or outwardly of the peripheral walls, and the lids are folded in the direction opposite to that of the bottom faces. Then, while the foldable peripheral walls are folded inwardly along the folding lines, the adjacent peripheral walls are brought closer to each other so that the lids, peripheral walls, and bottom faces overlap with one another.

In the present invention, because each of the four peripheral walls, two lids, and two bottom faces is formed of a sheet material enveloping a vacuum heat-insulating material therein, excellent cold-insulating performance is exhibited.

In the present invention, all the peripheral walls, lids, and bottom faces of the cold-insulating container are connected so as to be foldable. The cold-insulating container can be assembled into a box configuration or collapsed into an overlapping configuration with all the members connecting to one another. This structure eliminates the labor hours taken to attach or detach another member to or from the cold-insulating container; thus considerably reducing the labor hours taken for assembly and collapse. Because respective members are connected one another, there is no possibility of missing one of the members during assembly and collapse.

In the present invention, because each face of the cold-insulating container is formed of a sheet material enveloping a vacuum heat-insulating material therein, each face has a high strength and rigidity. This structure improves the strength and rigidity of the assembled box. When the cold-insulating container is collapsed, the foldable peripheral walls are folded inwardly along the folding lines. Thus, the cold-insulating container can be collapsed into a downsized shape without the foldable peripheral walls protruding from the adjacent peripheral walls, and is convenient for collection and storage.

In the present invention, when the cold-insulating containers having housed frozen products during delivery are kept at a destination and collected at the time of the next delivery, the cold-insulating containers after use can easily be collapsed at the destination for a short period of time for storage in a small space. Additionally, because no member is removed during collapsing operation as described above, there is no possibility of missing members.

In the present invention, preferably, the sheet material is formed of a waterproof cloth. The waterproof cloth can prevent water adhering to the sheet material of the inner surfaces of the peripheral walls, bottom faces, and lids from penetrating into the inside thereof. Additionally, the waterproof cloth has no dimensional change caused by moisture absorption, and prevents displacement of the vacuum heat-insulating material enveloped.

In the present invention, the cold-insulating container has the following structure in the above method of delivering frozen products. One of the lids includes an engaging flap including a flexible hook-and-loop fastener along the side edge thereof engaging with the other lid. The other lid includes a hook-and-loop fastener in a portion corresponding with the engaging flap. Thus, turning the two lids into a closed position matches the side edges of both lids and brings the engaging flap on the one lid into contact with the other lid to engage both hook-and-loop fasteners each other.

Structures for engaging the two lids include turning the two lids into a closed position to overlap both ends each other for engagement. However, with this structure, an increase in the thickness of the lids generates a step between the engaged lids, and thus gaps between the lids and foldable peripheral walls. For this reason, the inside and outside of the cold-insulating container communicates through the gaps and the cold-insulating performance thereof is affected.

In the present invention, turning the two lids of the cold-insulating container into a closed position matches the side edges of both lids each other. With this structure, even an increase in the thickness of the lids does not generate a step between the two lids, and thus no gaps between the lids and the upper side edges of the foldable peripheral walls.

Additionally, because the engaging flap on one lid is brought into contact with the other lid to engage both hook-and-loop fasteners each other, the portion in which the side edges of both lids match with each other is covered with the engaging flap. With this structure, the engaging flap can shield the portion in which the side edges of both lids match with each other to block communication between the inside and outside. Thus, cold-insulating performance is improved.

Because the engaging flap is flexible, grasping a part of the engaging flap can easily release the engagement of the hook-and-loop fasteners.

The structure of the present invention can also be used for the bottom faces of the cold-insulating container.

Application of the structure of the present invention to the bottom faces of the cold-insulating container prevents generation of gaps between the bottom faces and the foldable peripheral walls in engagement of both bottom faces, even when the thickness of the bottom faces is increased. Additionally, because the engaging flap on one bottom face is brought into contact with the other bottom face to engage two hook-and-loop fasteners each other, the engaging flap covers the portion in which side edges of the bottom faces match with each other, and thus further can increase shielding property.

In the present invention, the cold-insulating container has the following structure in the above method of delivering frozen products. Each of the two foldable peripheral walls of the cold-insulating container includes a flexible engaging flap including a hook-and-loop fastener along an upper side edge thereof so that the flap is urged upwardly rather than laterally. Each of the two lids includes hook-and-loop fasteners corresponding with the hook-and-loop fasteners on the engaging flaps. When the two lids are turned into a closed position, the lids depress the engaging flaps and make into contact with the flaps so that the hook-and-loop fasteners on the engaging flaps and the corresponding ones on the lids engage with each other.

Now, even when matching the side edges of the lids for engagement using the engaging flap is used as a structure of engaging the two lids of the cold-insulating container in a closed position, the lids and the foldable peripheral walls are brought into contact with each other only along the sides thereof. This contact is likely to generate gaps between the lids and foldable peripheral walls, and is a factor in affecting the cold-insulating performance.

In the present invention, because the cold-insulating container includes engaging flaps along the upper side edges of the foldable peripheral walls, turning the lids into a closed position allows the inner surfaces of the lids to depress the engaging flaps inwardly. Then, the hook-and-loop fasteners on the engaging flaps and the corresponding ones on the lids engage with each other. This structure can shield each gap between the foldable peripheral wall and the lid with the engaging flap, prevents generation of the gap, and improves the cold-insulating performance.

In the present invention, the engaging flaps are urged upwardly rather than laterally. With this structure, only turning the lid against the urging force of the engaging flaps can naturally engage the hook-and-loop faster on the engaging flap with the corresponding ones on the lids.

In the present invention, as a structure of urging the engaging flap upwardly rather than laterally, a material (cloth) having restoring force is used for the engaging flap, and the engaging flaps are sewn onto the sheet material of the upper side edges of the foldable peripheral walls substantially upwardly, for example. With this structure, the engaging flaps do not hang even in an extended period of use, and only turning the lids into a closed position ensures engagement of the hook-and-loop fasteners.

In the present invention, the cold-insulating container has the following structure in the above method of delivering frozen products. When the container is collapsed, the bottom faces are folded inwardly of the peripheral walls and the lids are folded outwardly of the peripheral walls. In use, a flexible bottom sheet for covering the entire external surface of the two bottom faces is attached along the lower side edges of the four peripheral walls.

In the present invention, the entire external surface of the bottom faces of the cold-insulating container is covered with a bottom face sheet. This sheet blocks communication between the inside and outside even when gaps are generated between the two bottom faces or between the foldable peripheral walls and the bottom faces in the closed position of the bottom faces. Thus, the cold-insulating performance is not affected.

In the present invention, because the bottom faces of the cold-insulating container are folded inwardly of the peripheral walls, the bottom face sheet does not hamper collapsing operation. Additionally, because the bottom sheet is flexible, the sheet can easily be housed inwardly of the peripheral walls in the collapsing operation.

In the present invention, preferably, the bottom face sheet is formed of a waterproof cloth. A bottom face sheet formed of a waterproof cloth can inhibit water from flowing out of the cold-insulating container even when ice adhering to housed frozen products melts and flows into the inside of the container.

The present invention provides a collapsible cold-insulating container including four peripheral walls, a bottom face, and an openable and closable lid. Each of the members is formed of a sheet material enveloping a planar vacuum heat-insulating material therein. The cold-insulating container is collapsible with respective members forming a box in use, and respective members overlapping with one another not in use.

In the present invention, the use of the vacuum heat-insulating material can provide excellent cold-insulating performance. Each of the peripheral walls, bottom face, and lid is integrally formed of a sheet material enveloping a planar vacuum heat-insulating material therein. Thus, the heat-insulating container can be assembled and collapsed for a short period of time without labor hours taken to remove the vacuum heat-insulating material. This structure can provide a collapsible cold-insulating container with excellent cold-insulating performance and collapsible for easy collection and storage not in use.

The present invention provides a collapsible cold-insulating container having the following structure. The cold-insulating container includes: four peripheral walls connected into a square shape so as to be foldable one another; two lids connected to two opposed ones of the peripheral walls along the upper side edges thereof so as to be foldable; two bottom faces that are connected to the two peripheral walls connected to the lids, along the lower side edges thereof, so as to be foldable. Each of the peripheral walls, lids, and bottom faces is formed of a sheet material enveloping a planar vacuum heat-insulating material therein. In each of the two peripheral walls adjacent to the peripheral walls connected to the lids and bottom faces, the vacuum heat-insulating material is divided along a folding line extending in the direction of the height thereof in substantially a central part, so as to be foldable. The container has a collapsible structure. In use, the two lids and bottom faces are turned into a closed position for engagement to form a box. Not in use, the engagement of the lids and bottom faces is released, the bottom faces are folded inwardly or outwardly of the peripheral walls, and the lids are folded in the direction opposite to that of the bottom faces. Then, while the foldable peripheral walls are folded inwardly along the folding lines, the adjacent peripheral walls are brought closer to each other so that the lids, peripheral walls, and bottom faces overlap with one another.

In the present invention, because each of the four peripheral walls, two lids, and two bottom faces is formed of a sheet material enveloping a vacuum heat-insulating material therein, excellent cold-insulating performance is exhibited.

In the present invention, all the peripheral walls, lids, and bottom faces of the cold-insulating container are connected so as to be foldable. The cold-insulating container can be assembled into a box configuration or collapsed into an overlapping configuration with all the members connecting to one another. This structure eliminates the labor hours taken to attach or detach another member to or from the cold-insulating container, thus considerably reducing the labor hours taken for assembly and collapse. Because respective members are connecting to one another, there is no possibility of missing one of the members.

In the present invention, because each face of the cold-insulating container is formed of a sheet material enveloping a vacuum heat-insulating material therein, each face has a high strength and rigidity. This structure improves the strength and rigidity of the assembled box. When the cold-insulating container is collapsed, the foldable peripheral walls are folded inwardly along the folding lines. Thus, the cold-insulating container can be collapsed into a downsized shape without the foldable peripheral walls protruding from the adjacent peripheral walls, and is convenient for collection and storage.

This structure can provide a collapsible cold-insulating container that can easily be assembled prior to use, exhibit excellent cold-insulating performance, and easily be collapsed for a short period of time for collection and storage not in use.

The present invention has the following structure in the above collapsible cold-insulating container. One of the lids includes an engaging flap including a flexible hook-and-loop fastener along the side edge thereof engaging with the other lid. The other lid includes a hook-and-loop fastener in a portion corresponding with the engaging flap. Thus, turning the two lids into a closed position matches the side edges of both lids and brings the engaging flap on the one lid into contact with the other lid to engage both hook-and-loop fasteners each other.

Structures of engaging the two lids include turning the two lids into a closed position to overlap both ends each other for engagement. However, with this structure, an increase in the thickness of the lid generates a step between the engaged lids, and thus gaps between the lids and foldable peripheral walls. For this reason, the inside and outside of the cold-insulating container communicates through the gaps and the cold-insulating performance is affected.

In the present invention, turning the two lids of the cold-insulating container into a closed position matches the side edges of both lids each other. With this structure, even an increase in the thickness of the lids does not generate a step between the two lids, and thus gaps between the lids and the upper side edges of the foldable peripheral walls.

Additionally, because an engaging flap on the one lid is brought into contact with the other lid to engage both hook-and-loop fasteners, the portion in which the side edges of both lids match with each other is covered with the engaging flap. With this structure, the engaging flap can shield the portion in which the side edges of both lids match with each other to block communication between the inside and outside. Thus, the cold-insulating performance is improved.

Because the engaging flap is flexible, grasping a part of the engaging flap can easily release the engagement of the hook-and-loop fasteners.

The structure of the present invention can also be used for the bottom faces.

Application of the structure of the present invention to the bottom faces prevents generation of gaps between the bottom faces and the foldable peripheral walls in engagement of both bottom faces, even when the thickness of the bottom faces is increased. Additionally, because the engaging flap on one bottom face is brought into contact with the other bottom face to engage the two hook-and-loop fasteners each other, the engaging flap covers the portion in which the side edges of the bottom faces match with each other, and thus further can increase shielding property.

This structure can improve the shielding property of the cold-insulating container, and provide a collapsible cold-insulating container with improved cold-insulating property that can easily be assembled and collapsed.

The present invention has the following structure in the above collapsible cold-insulating container. Each of the two foldable peripheral walls includes a flexible engaging flap including a hook-and-loop fastener along the upper side edge thereof so that the flap is urged upwardly rather then laterally. Each of the two lids includes hook-and-loop fasteners corresponding with the hook-and-loop fasteners on the engaging flaps. When the two lids are turned into a closed position, the lids depress the engaging flaps and make into contact with the flaps so that the hook-and-loop fasteners on the engaging flaps and the corresponding ones on the lids engage with each other.

Now, even when the structure of claim 3, i.e. matching the side edges of the lids for engagement using the engaging flaps, is used as a structure of engaging the two lids in a closed position, the lids and the foldable peripheral walls are brought into contact with each other only along the sides thereof. This contact is likely to generate gaps between the lids and foldable peripheral walls, and is a factor in affecting the cold-insulating performance.

In the present invention, because the engaging flaps are provided along the upper side edges of the foldable peripheral walls, turning the lids into a closed position allows the inner surfaces of the lids to depress the engaging flaps inwardly. Then, the hook-and-loop fasteners on the engaging flaps and the corresponding ones on the lids engage with each other. This structure can shield each gap between the foldable peripheral wall and the lid with the engaging flap, prevents generation of the gap, and improves cold-insulating performance.

In the present invention, the engaging flaps are urged upwardly rather than laterally. With this structure, only turning the lid against the urging force of the engaging flaps can naturally engage the hook-and-loop faster on the engaging flap with the corresponding ones on the lids.

In the present invention, as a structure of urging the engaging flap upwardly rather than laterally, a material (cloth) having restoring force is used for the engaging flaps, and the engaging flaps are sewn onto the sheet material of the upper side edges of the foldable peripheral walls substantially upwardly, for example. With this structure, the engaging flaps do not hang even in an extended period of use, and only turning the lids into a closed position ensures engagement of the hook-and-loop fasteners.

This structure can improve the shielding property of the cold-insulating container, and provide a collapsible cold-insulating container with improved cold-insulating property that can easily be assembled and collapsed.

The present invention has the following structure, in the above cold-insulating container. When the container is collapsed, the bottom faces are folded inwardly of the peripheral walls and the lids are folded outwardly of the peripheral walls. In use, a flexible bottom sheet for covering the entire external surface of the two bottom faces is attached along the lower side edges of the four peripheral walls.

In the present invention, the entire external surface of the bottom faces of the cold-insulating container is covered with a bottom face sheet. This sheet blocks communication between the inside and outside even when gaps are generated between the two bottom faces or between the foldable peripheral walls and the bottom faces in the closed position of the bottom faces. Thus, the cold-insulating performance is not affected.

Even when ice adhering to housed frozen products melts and flows into the inside of the cold-insulating container, the bottom face sheet can inhibit water from flowing out of the container.

In the present invention, because the bottom faces are folded inwardly of the peripheral walls, the bottom face sheet does not hamper collapsing operation. Additionally, because the bottom face sheet is flexible, the sheet can easily be housed inwardly of the peripheral walls.

Thus, improvement of shielding property of the cold-insulating container can provide a collapsible cold-insulating container with improved cold-insulating property.

In the present invention, the vacuum heat-insulating material is structured, in the above collapsible cold-insulating container, so that a core material made by compression-molding fiber materials is covered with a gas-barrier jacket material, and the inside covered with the jacket material is depressurized for vacuum encapsulation.

In the present invention, the heat-insulating property thereof is considerably higher than that of a conventional heat-insulating material. For this reason, even when a thin vacuum heat-insulating material is used, necessary cold-insulating performance can be ensured. A cold-insulating container having the same internal capacity can be made into a more downsized shape.

Additionally, using a material with high strength and rigidity as a jacket material can improve strength and rigidity of each of the lids, peripheral walls, and bottom faces made of a sheet material enveloping a vacuum heat-insulating material therein.

This structure can provide a collapsible cold-insulating container with a considerably high cold-insulating property.

The present invention is structured, in the above collapsible cold-insulating material, so that the thickness of a vacuum heat-insulating material thereof ranges from 2 to 20 mm (inclusive).

When the thickness of the vacuum heat-insulating material is up to 2 mm, the rigidity and strength thereof are low even with necessary cold-insulating performance, and damage is likely to be caused by external force. When the thickness of the vacuum heat-insulating material exceeds 20 mm, the cold-insulating performance thereof increases unnecessarily. This is a factor in inhibiting the cold-insulating container from being more downsized and cost-saving. Vacuum heat-insulating materials having a thickness ranging from 2 to 20 mm (inclusive) are preferable. In consideration of cold-insulating performance, downsizing, and cost saving, those having a thickness of approx. 10 mm are the most preferable.

This structure can reduce the thickness of the vacuum heat-insulating material while ensuring the cold-insulating performance thereof, and provide a collapsible cold-insulating container having a downsized shape with respect to the internal capacity thereof.

The present invention is structured, in the above collapsible heat-insulating container, so that a vacuum heat-insulating material having an initial thermal conductivity up to 0.01 W/mK is used.

In the present invention, the use of a vacuum heat-insulating material having an (initial) thermal conductivity in the above range can considerably increase the heat-insulating property. This property can reduce the thickness of the heat-insulating material, and downsize the cold-insulating container while ensuring necessary cold-insulating performance.

A vacuum heat-insulating material having an (initial) thermal conductivity up to 0.01 W/mK is preferable. When improvements in cold-insulating performance and reduction in thickness are intended, those having a thermal conductivity up to 0.006 W/mK are more preferable, and those having a thermal conductivity up to 0.003 W/mK are the most preferable.

This structure can reduce the thickness of the vacuum heat-insulating material while ensuring the cold-insulating performance thereof, and provide a collapsible cold-insulating container having a downsized shape with respect to the internal capacity thereof.

The present invention is structured, in the above collapsible cold-insulating container, so that a cold-storage agent having a melting point ranging from −27 to −18° C. (inclusive) is housed inside thereof.

In wholesalers or distribution centers where small cargo deliveries of frozen products are performed using cold-insulating containers, the freezers thereof are generally controlled at temperatures ranging from −30 to −22° C. (inclusive).

In the present invention, a cold-storage agent having a melting point ranging from −27 to −18° C. can be stored in a freezer according to the temperature setting thereof, so as to be solidified. Thus, the cold-storage agent can be housed in the cold-insulating container immediately before delivery available for cold insulation.

Thus, the cold-storage agent can easily be solidified only by storage in the freezer, and thus a collapsible cold-insulating container with improved workability can be provided.

The present invention is structured, in the above collapsible cold-insulating container, so as to house at least 1 kg of cold-storage agent per internal capacity of 50 l, and maintain the average inside temperature up to 0° C. for 10 hours or longer.

In the present invention, with the improvement of the heat-insulating property of the vacuum heat-insulating material, a low inside average temperature can be maintained for an extended period of time only by placement of a cold-storage agent in the cold-insulating container. This allows long-time delivery without affecting the quality of frozen products.

In the present invention, only placement of a small amount of cold-storage agent in the cold-insulating container can maintain a predetermined temperature for an extended period of time. For this reason, a decrease in the cold-insulating temperature immediately after the placement of the cold-storage agent can be made smaller than that of a case where a large amount of cold-storage agent is placed. Thus, a problem of freezing on frozen products can be avoided. In other words, unlike a conventional cold-insulating container, it is unnecessary to check that the inside temperature of the container has been increased to a certain degree after placement of a large amount of cold-storage agent and then store frozen products in the cold-insulating container.

Therefore, the present invention can provide a collapsible cold-insulating container in which the use of a small amount of cold-storage agent allows long-time cold insulation and long-time delivery without affecting the quality of frozen products.

The present invention is structured, in the above collapsible cold-insulating container, to have an internal capacity of 70 l or larger.

In the present invention, the capacity is appropriate for the volume of frozen products sorted for each destination of small-cargo delivery. Additionally, the weight of housed frozen products is appropriate and thus sorting and delivery operations can efficiently be performed.

An appropriate weight of housed frozen products and appropriate capacity for housing the sorted frozen products can provide a collapsible cold-insulating container allowing efficient delivery operation.

The present invention is structured, in the above collapsible cold-insulating container, so that at least one of a sheet material, engaging flaps, and bottom face sheet is made of a waterproof cloth.

In the present invention, any or all of the sheet material structuring the peripheral walls, bottom faces, and lids, engaging flaps on the lids and peripheral walls, and the bottom face sheet covering the external surface of the bottom faces is made of a waterproof cloth. The waterproof cloth can prevent water adhering to the sheet material of the inner surfaces of peripheral walls, bottom faces, or lids from penetrating into the inside thereof. Additionally, the waterproof cloth has no dimensional change caused by moisture absorption, and prevents displacement of the vacuum heat-insulating material enveloped. Prevention of water from penetrating into the engaging flaps can improve durability. Further, the bottom face sheet can prevent water from flowing out of the cold-insulating container.

In the present invention, as a waterproof cloth, a cloth of polyester material with waterproof finish, for example, can be used.

This waterproof cloth can prevent water from penetrating into each member and from flowing out of the container, and thus provide a collapsible cold-insulating container with improved durability and working efficiency.

The present invention is structured, in the above collapsible cold-insulating container, to have additional strengthening on at least one face facing to the outside in use or not in use, among the faces of peripheral walls, lids, and bottom faces.

When the cold-insulating container is in use, the external surfaces of the four peripheral walls, the external surfaces of the two lids, and the external surfaces of the two bottom faces face to the outside. For this reason, during delivery of frozen products using the cold-insulating container, external force is likely to be exerted on each face facing to the outside, and thus to damage the vacuum heat-insulating material.

When the cold-insulating container is not in use, folding the two lids outwardly of the peripheral wall faces the inner surfaces of the lids to the outside, though it depends on collapsing methods. For this reason, external force is likely to be exerted on the inner surfaces of the lids, thus damaging the vacuum heat-insulating material in some cases.

Because the present invention has additional strengthening on each of these faces susceptible to external force, the vacuum heat-insulating material is protected and the container has improved durability.

Additional strengthening includes: a structure of increasing the thickness or strength of the sheet material enveloping the vacuum heat-insulating material therein; and a structure of inserting reinforcement with high rigidity between the sheet material and vacuum heat-insulating material.

Such additional strengthening can protect the vacuum heat-insulating material from external force in use and not in use, and provide a collapsible cold-insulating container with improved durability.

The present invention is structured, in the above collapsible cold-insulating container, to have a cold-storage agent holder for holding the cold-storage agent therein on the inner surface of at least one of lids, peripheral walls, and bottom faces.

In the present invention, the cold-storage agent does not move in the cold-insulating container during delivery, or movement of the cold-storage agent does not damage the sheet material or frozen products.

The cold-storage agent holder can be formed by attaching a mesh-like net material onto the inside surface of one of the peripheral walls, for example. Such a holder facilitates insertion of the cold-storage agent and does not affect the cold-insulating effect.

This structure can provide a collapsible cold-insulating container capable of holding a cold-storage agent easily with improved workability.

The present invention is structured, in the above collapsible cold-insulating container, so that a flexible inner cover is provided inside of the lids, the inner cover is attached along the upper side edge of the peripheral wall connecting to one of the lids, and the inner cover is equal to or longer than the length from the upper side edge to the bottom edge of the inner surface of the facing peripheral wall.

In the present invention, placement of an inner cover inside of the lids can improve the property of shielding the inside from outside, further improving the cold-insulating performance.

Further, in the present invention, because the inner cover has the above length, the inner cover can securely cover the bottom faces even when frozen products are housed in a part of the cold-insulating container. Thus, the cold-insulating performance can be improved.

In the present invention, the inner cover can be formed of a flexible sheet material. The inner cover can also be structured so that a sheet material envelops a (vacuum) heat-insulating material therein to improve the heat-insulating property of the inner cover.

This structure can provide a collapsible heat-insulating container that has the cold-insulating property improved by the improvement of the property of shielding the inside from outside.

Further, the present invention is structured, in the above collapsible cold-insulating container, to have a cold-storage agent holder for holding the cold-storage agent therein on the inner surface of at least one of the lids, peripheral walls, bottom faces, and inner cover.

In the present invention, the cold-storage agent does not move in the cold-insulating container during delivery, or movement of the cold-storage agent does not damage the sheet material or frozen products.

The cold-storage agent holder can be formed by attaching a mesh-like net material onto the inner surface of one of the peripheral walls, for example. Such a holder facilitates insertion of the cold-storage agent and does not affect the cold-insulating effect.

In the structure of providing an inner cover inside of a cold-insulating container, it is preferable to provide a cold-storage agent holder on the inner surface of the peripheral wall having the inner cover attached thereto. Placement of the cold-storage agent holder in this position allows the cold-storage agent and housed frozen products to be covered with the inner cover together, thus further improving the cold-insulating performance.

This structure can provide a collapsible cold-insulating container capable of housing a cold-storage agent with improved workability.

Further, the present invention is structured, in the above collapsible cold-insulating container, so that, in each of the two lids and two bottom faces, the length from the lid to the facing bottom face and the length from the bottom face to the facing lid are smaller than the height of the peripheral walls.

The present invention is structured, in the above collapsed cold-insulating container, so that the respective facing lids and bottom faces do not protrude from the outside dimension of the peripheral walls in a collapsed configuration thereof. This structure can reduce the collapsed size of the cold-insulating container, and facilitates collection and storage thereof.

This structure can provide a collapsible cold-insulating container that can be collapsed into a downsized shape.

The present invention is structured, in the above collapsed cold-insulating container, to have a protective case for housing the collapsible cold-insulating containers. The protective case is structured to houses a collapsible cold-insulating container formed into a box configuration in use, and houses a plurality of collapsible cold-insulating containers in a collapsed configuration not in use.

Structuring a cold-insulating container of the preset invention using a vacuum heat-insulating material with a predetermined strength and rigidity can provide the strength and rigidity of a single body of the cold-insulating container. However, excessive external force exerted on the cold-insulating container during delivery can damage the container, in some cases. When the cold-insulating containers are piled up in a plurality of layers, strength thereof may be insufficient.

In the present invention, housing the cold-insulating container in the protective case can prevent external force exerted directly on the cold-insulating container, and thus damage to the cold-insulating container.

Even when cold-insulating containers are housed in the protective cases and piled up in a plurality of layers, the protective cases support the weight of the cold-insulating containers on the upper side and the load is not exerted directly onto the cold-insulating containers. This structure can prevent damage to the cold-insulating containers. In this case, piling up the protective cases to form an engageable structure further improves the working efficiency.

In the present invention, a plurality of cold-insulating containers collapsed not in use can be housed inside of the protective case for efficient collection and storage thereof.

A protective case formed of a synthetic resin molded form can provide a light weight, and sufficient strength and rigidity to the protective case. Additionally, forming the protective case into a collapsible structure facilitates collection thereof after delivery; thus reducing the storage space.

The protective case can reduce external force exerted on the collapsible cold-insulating containers and improve durability thereof, and further facilitate delivery and storage of the collapsible cold-insulating container.

A description is provided of exemplary embodiments of the present invention with reference to the accompanying drawings. In the description, same elements used in the conventional example or the aforementioned description are denoted with the same reference marks, and detailed description thereof is omitted. These exemplary embodiments do not limit the present invention.

Figure 3:
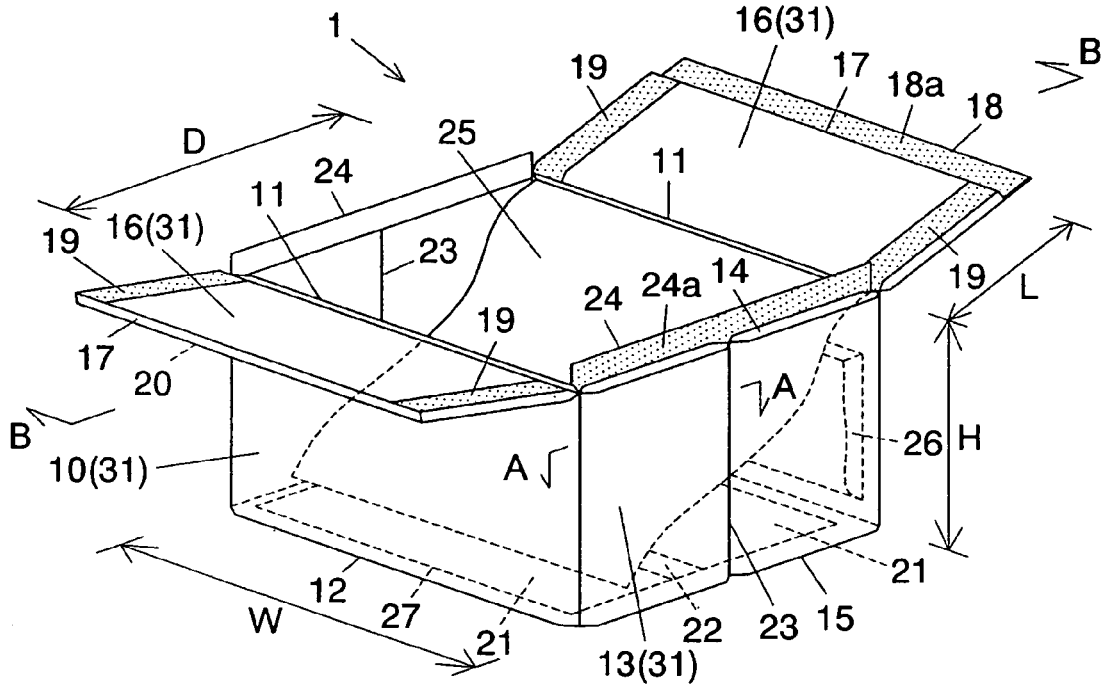
FIG. 3 is a perspective view illustrating a cold-insulating container for use in the delivery methods shown in FIGS. 1A through 1D, and FIGS. 2A through 2D.
Figure 4:
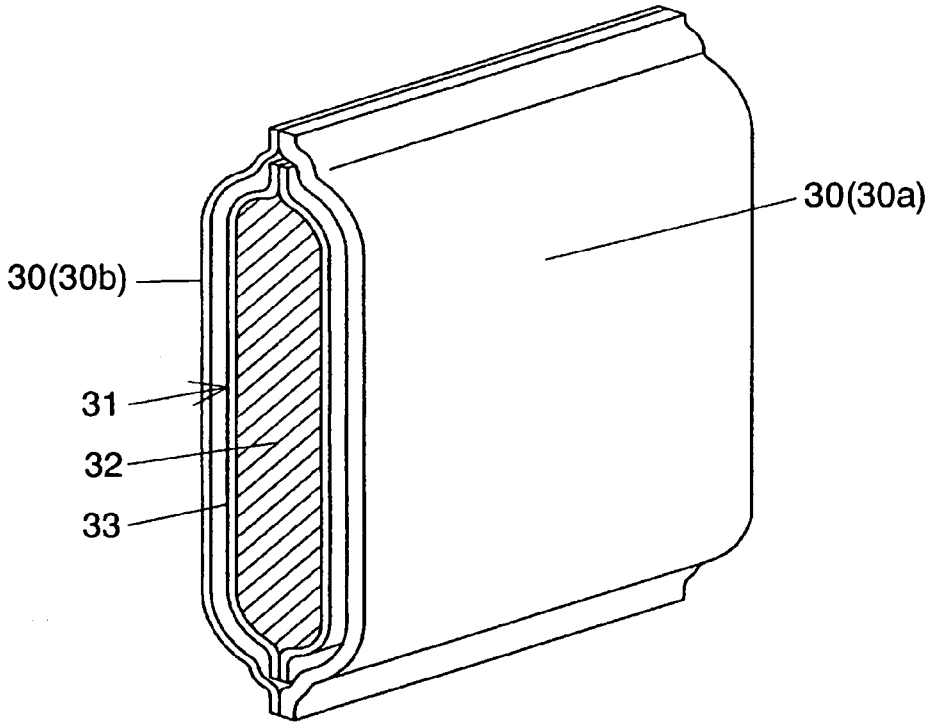
FIG. 4 is a sectional view taken along line A-A of FIG. 3
Figure 5:
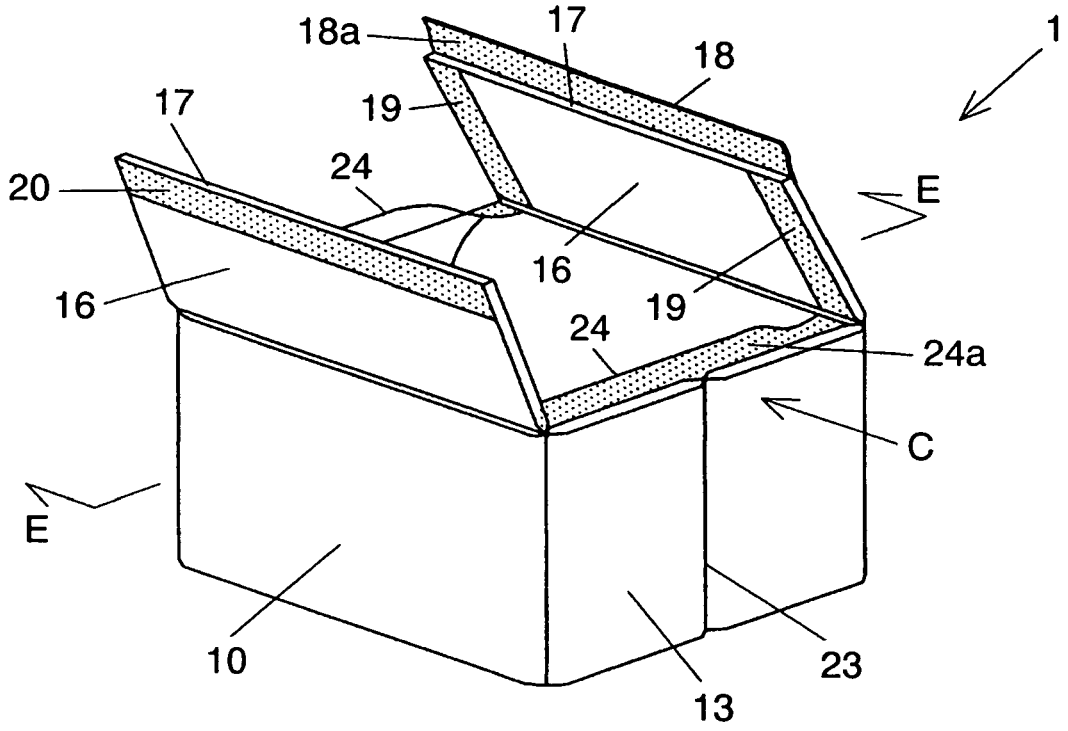
FIG. 5 is a perspective view showing a state in which lids of the cold-insulating container of FIG. 3 are closed.
Figure 6:
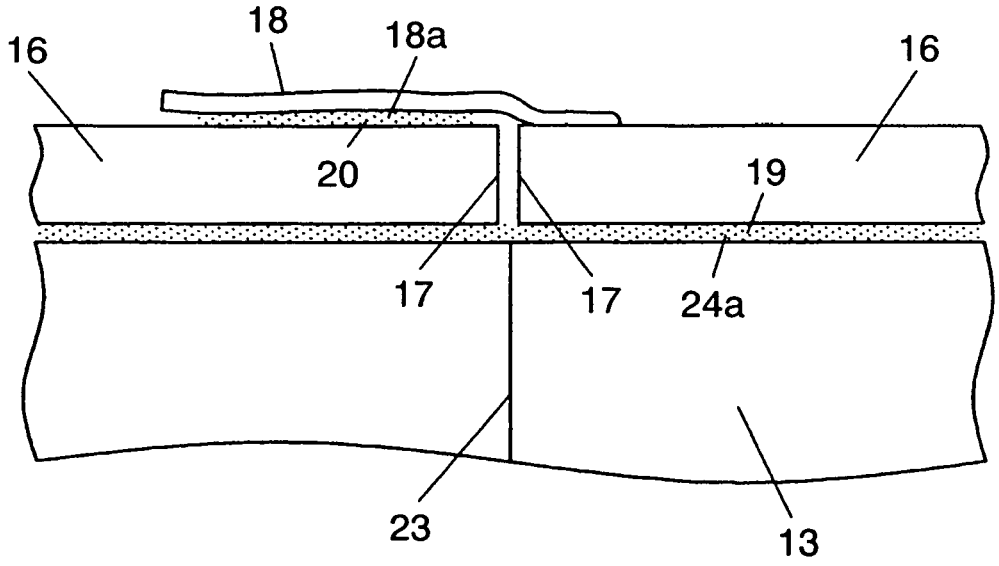
FIG. 6 is a view taken in the direction of arrow C of FIG. 5.
Figure 7:
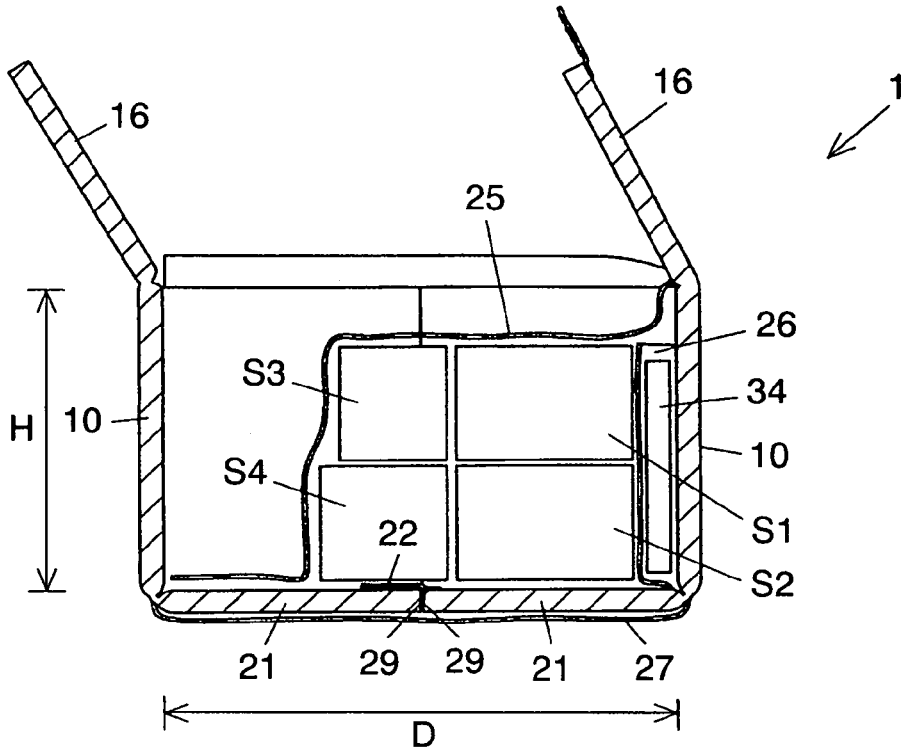
FIG. 7 is a sectional view taken along line E-E of FIG. 5.
Figure 8:
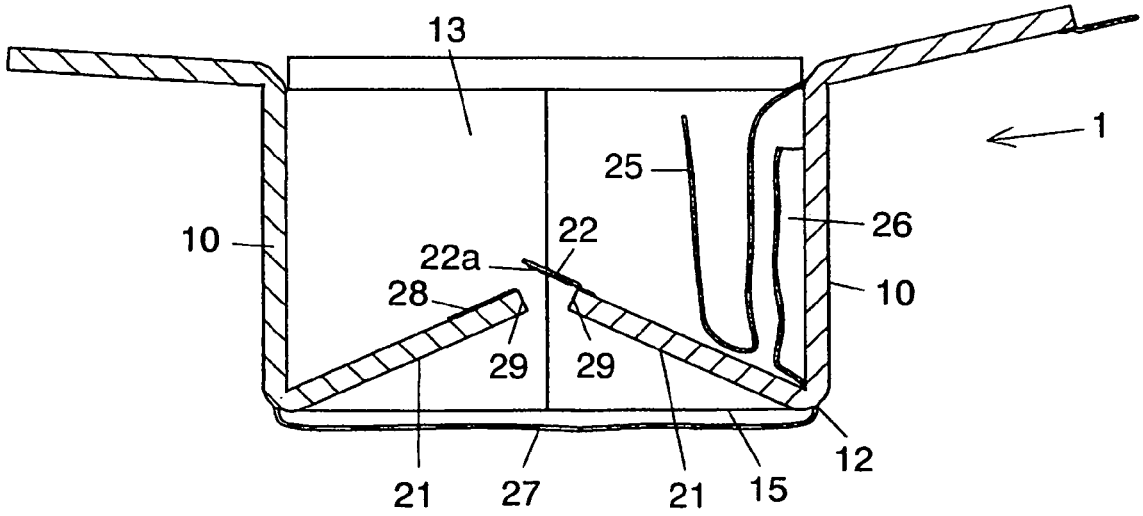
FIG. 8 is a sectional view showing a state in which engagement of the bottom faces is released in the sectional view taken along line B-B of FIG. 3.
Figure 9B:
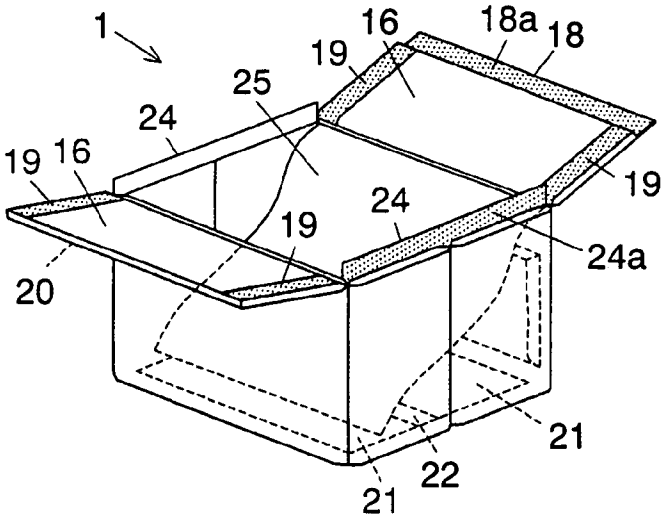
FIGS. 9A, 9B, 9C, 9D, and 9E are perspective views illustrating steps of collapsing the cold-insulating container of FIG. 3

FIGS. 1A through 1D are explanatory views illustrating a method of delivering frozen products in accordance with a first exemplary embodiment of the present invention. FIGS. 2A through 2D are explanatory views illustrating a method of delivering frozen products in accordance with a second exemplary embodiment of the present invention. FIG. 3 is a perspective view illustrating cold-insulating container 1 for use in the delivery methods of the first and second exemplary embodiments. FIG. 4 is a sectional view taken along line A-A of FIG. 3. FIG. 5 is a perspective view showing a state in which the lids of cold-insulating container 1 of FIG. 3 are closed. FIG. 6 is a view taken in the direction of arrow C of FIG. 5. FIG. 7 is a sectional view taken along line E-E of FIG. 5. FIG. 8 is a sectional view showing a state in which engagement of the bottom faces is released in the sectional view taken along line B-B of FIG. 3. FIGS. 9A through 9E are perspective views illustrating steps of collapsing cold-insulating container 1 of FIG. 3. FIG. 10A is a perspective view illustrating a state in which cold-insulating container 1 of FIG. 3 is housed in a protective case. FIGS. 10B and 10C are perspective views illustrating a state in which cold-insulating containers 1 collapsed not in use are housed in the protective case.

Cold-insulating container 1 for use in the first exemplary embodiment is a box-shaped container, as shown in FIG. 1, made of four peripheral walls 10, 10, 13, and 13, and bottom face 21, and two lids 16, and 16.

Each of these peripheral walls 10 and 13, bottom face 21, and lids 16 is formed of a sheet material enveloping vacuum heat-insulator 31 therein, and has extremely high heat-insulating property.

Cold-insulating container 1 for use in this exemplary embodiment measures 600 mm in width, 400 mm in depth, and 300 mm in height, and has an internal capacity of approx. 70 l.

In cold-insulating container 1, peripheral walls 10 and 13, bottom face 21, and lids 16 are connected so as to be foldable each other. As will be described hereinafter, the container is structured so that these members overlap with one another into a collapsible configuration.

In the delivery method of the present invention, tests are previously conducted on cold-insulating containers 1 loaded in each delivery vehicle M (refrigerator vehicle M1, cold-insulating vehicle M2, and room-temperature vehicle M3) to determine the approximate shelf lives of frozen products S with respect to the percentages of frozen products S in cold-insulating containers 1. In other words, according to the tests, a table of approximate shelf lives is created, as shown in Table 1.

(Table 1)

TABLE 1

Table of Shelf Life

| Percentage of stored frozen products (%) | Shelf life (hours) Refrigerator vehicle | Cold-insulating vehicle | Room-temperature vehicle |
|---|---|---|---|
| 40 | 1.0 | — | — |
| 60 | 1.5 | 0.5 | — |
| 80 | 2.0 | 1.0 | — |
| 100 | 2.5 | 1.5 | 0.5 |

As obvious from Table 1, because the inside temperature of the refrigerator vehicle is set to a refrigerating temperature, the shelf lives of frozen products S are longer. Additionally, because the storage of a refrigeration vehicle has heat-insulating property, the shelf lives of frozen products S are longer than those in a room-temperature vehicle.

In this embodiment, the data in Table 1 is created, provided that the quality of frozen products S can be maintained at an average inside temperature of cold-insulating container 1 up to 0° inside.

Prior to delivery of frozen products S, as shown in FIG. 1A, frozen products S (S1 through S4) to be delivered are housed in cold-insulating container 1. Then, the approximate percentage of housed frozen products S is visually estimated. Next, the time taken to the destination is examined. The type of vehicle is selected to ensure a shelf life longer than the time taken for delivery, with reference to the column corresponding with the percentage of housed frozen products in Table 1.

In other words, for example, when the percentage of housed frozen products S in cold-insulating container 1 is approx. 80%, and the time taken to the destination is approx. 1.5 hours, only a refrigerator vehicle can ensure delivery with the maintained quality.

In another case, when the percentage of housed frozen products S is approx. 100% and the time taken to the destination is approx. 30 minutes, any of a refrigerator vehicle, cold-insulating vehicle, and room-temperature vehicle can deliver.

Next, as shown in FIG. 1B, lids 16 and 16 of cold-insulating container 1 housing frozen products S are closed. As shown in FIG. 1C, cold-insulating containers 1 are loaded into delivery vehicle M. At this time, if delivery vehicle M is refrigerator vehicle M1, refrigerated products Q1 can be loaded in addition to cold-insulating containers 1 housing frozen products S. If delivery vehicle M is cold-insulating vehicle M2, cold-insulated products Q2 can be loaded in addition to cold-insulating containers 1 housing frozen products S. If delivery vehicle M is room-temperature vehicle M3, room-temperature products Q3 can be loaded in addition to cold-insulating containers 1 housing frozen products S.

In this manner, frozen products S and products Q that can be loaded in delivery vehicle M are delivered to a destination in gross. After the delivery of frozen products S and products Q to the destination, as shown in FIG. 1D, empty cold-insulating containers are collected, collapsed, and loaded in a collapsed configuration in delivery vehicle M.

In another case, after the delivery of cold-insulating containers 1 housing frozen products S to a destination, empty cold-insulating containers 1 can be collected at the next delivery. In this case, after frozen products S housed in cold-insulating containers 1 are taken out, empty cold-insulating containers 1 can be collapsed at the destination for storage. Thus, empty cold-insulating containers 1 do not waste a space, and the containers can easily be collected at the next delivery.

When frozen products S housed in cold-insulating containers 1 are delivered to a plurality of different destinations, determining vehicles capable of delivery with reference to Table 1 is more complicated. In such a case, vehicles capable of delivery can be determined on the basis of the average percentage of frozen products S housed in respective cold-insulating containers 1 and the average time taken to the different destinations, with reference to Table 1.

In this manner, in the method of delivering frozen products of this embodiment, because cold-insulating containers 1 have high cold-insulating performance, vehicles other than a freezer vehicle can deliver frozen products S housed in cold-insulating containers 1 without using a cold-storage agent. Thus, delivery cost is made smaller than that using a freezer vehicle. Additionally, this method allows delivery of products to originally be delivered by the delivery vehicle in gross, and can drastically reduce the delivery cost.

Further, delivering frozen products together with other refrigerated products at the same time can reduce the number of delivery vehicles to be used, thus allowing excellent delivery from the viewpoint of environmental protection.

Next, a description is provided of a delivery method of a second exemplary embodiment of the present invention with reference to FIG. 2.

Cold-insulating container 1 for use in the delivery method of the second exemplary embodiment has the same structure as cold-insulating container 1 for use in the first exemplary embodiment. For this reason, same elements used in the first exemplary embodiment are denoted with the same reference marks, and redundant description is omitted.

The delivery method of the first exemplary embodiment is to store only frozen products to be delivered in cold-insulating containers 1 for delivery, and suitable for short-time delivery.

In contrast, the delivery method of this exemplary embodiment is to store cold-storage agent 34 in addition to products S to be delivered in cold-insulating container 1 for delivery, and suitable for long-time delivery.

In the delivery method of this exemplary embodiment, tests are previously conducted on respective cases where cold-insulating containers 1 are loaded in each vehicle M (refrigerator vehicle M1, refrigeration vehicle M2, and room-temperature vehicle M3) to determine the delivery time in which each vehicle can deliver frozen products with the maintained quality with respect to the amount of cold-storage agent 34. In other words, according to the test results, a table of possible delivery time is created as shown in Table 2.

Table 2

TABLE 2

| Table of possible delivery time | | | |
|---|---|---|---|
| Amount of cold-storage agent (kg) per 301 | Possible delivery time (hours) | | |
| | Refrigerator vehicle | Cold-insulating vehicle | Room-temperature vehicle |
| 1 | 10 | 5 | 3 |
| 2 | 12 | 6 | 4 |
| 3 | 14 | 7 | 5 |

As obvious from Table 2, because the inside temperature of a refrigerator vehicle is set to a refrigerating temperature, the refrigerator vehicle can deliver products for a period of time longer than a cold-insulating vehicle and room-temperature vehicle. Additionally, because the storage of a refrigeration vehicle has heat-insulating property, the refrigeration vehicle can deliver products for a period of time longer than a room-temperature vehicle.

In this exemplary embodiment, the data in Table 2 is created, provided that the quality of frozen products S can be maintained at an average inside temperature of cold-insulating container 1 up to 0° C.

At delivery of frozen products 5, frozen products S (S1 through S4) are housed in cold-insulating container 1, as shown in FIG. 2A. Further, with reference to Table 2, the amount of cold-storage agent is determined according to the kind of delivery vehicles and the time taken to the destination.

In other words, when refrigerator vehicle M1 delivers products to a destination for 10 hours, for example, an amount of cold-storage agent of 1 kg per 50 l, i.e. the internal capacity of cold-insulating container 1, should be stored. Therefore, it can be understood that approx. 1.4 kg of cold-storage agent is necessary for 70 l, i.e. the internal capacity of cold-insulating container 1 of this exemplary embodiment.

Figure 2B:
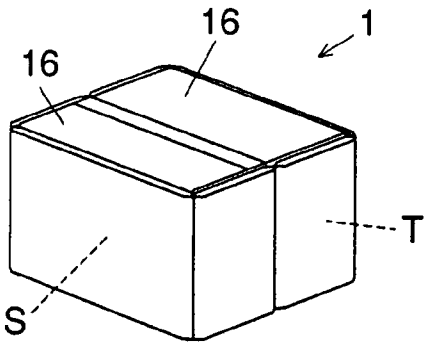
Figure 2C:
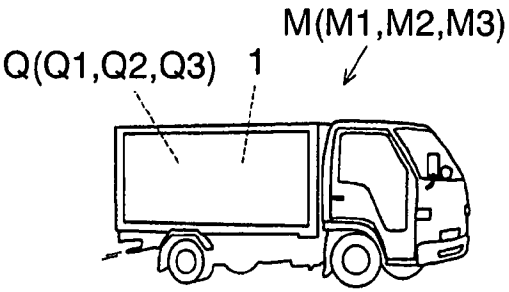

Next, as shown in FIG. 2A, frozen products S (S1 through S4) are housed in cold-insulating container 1 together with 1.4 g of cold-storage agent 34, which has been determined. Then, as shown in FIG. 2B, lids 16 and 16 of cold-insulating container 1 housing frozen products S and cold-storage agent 34 are closed and, as shown in FIG. 2C, cold-insulating containers 1 are loaded in delivery vehicle M.

At this time, if delivery vehicle M is refrigerator vehicle M1, refrigerated products Q1 can be loaded in addition to cold-insulating containers 1 housing frozen products S. If delivery vehicle M is cold-insulating vehicle M2, cold-insulated products Q2 can be loaded in addition to cold-insulating container 1 housing frozen products S. Similarly, if delivery vehicle M is room-temperature vehicle M3, room-temperature products Q3 can be loaded in addition to cold-insulating container 1 housing frozen products S.

Figure 2D:
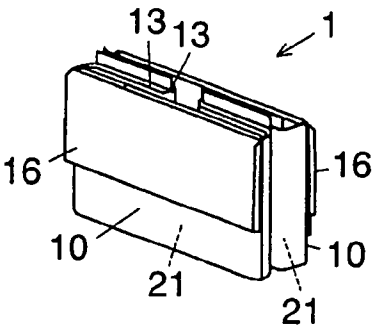

In this manner, frozen products S and products Q that can be loaded in delivery vehicle M are loaded at the same time for delivery to a destination. After delivery of frozen products S and products Q, as shown in FIG. 2D, empty cold-insulating containers 1 are collected and collapsed. Thus, collected cold-insulating containers 1 can easily be returned to delivery vehicle M.

In another case, similar to the first exemplary embodiment, when frozen products S are delivered to a destination with the products housed in cold-insulating containers 1, after all the frozen products S have been taken out, empty cold-insulating containers 1 can be collapsed at the destination for storage. Thus, empty cold-insulating containers 1 do not waste a space at the destination, and can easily be collected at the next delivery.

In this manner, in the method of delivering frozen products of this embodiment, cold-insulating containers 1 have high cold-insulating performance, and vehicles other than a freezer vehicle can deliver frozen products S using cold-storage agent 34 for a long period of time. Thus, delivery cost is smaller than that using a freezer vehicle. Additionally, this method allows delivery of products to originally be delivered by the delivery vehicle in gross, and can drastically reduce the delivery cost.

Further, delivering frozen products together with other refrigerated products at the same time can reduce the number of delivery vehicles to be used, thus allowing excellent delivery from the viewpoint of environmental protection.

Incidentally, in the description of the first and second exemplary embodiments, cold-insulating container 1 has a collapsible structure. However, the delivery method of the present invention can be implemented using a cold-insulating container formed into a fixed box.

In the description of the exemplary embodiments, refrigerator vehicle M1, cold-insulating vehicle M2, and room-temperature vehicle M3 are used as delivery vehicles. However, for example, even without cold-insulating vehicle M2, creating data in Tables 1 and 2 for refrigerator vehicle M1 and room-temperature vehicle M3 also allows delivery of the frozen products in a similar manner.

Next, a description is provided of a specific exemplary embodiment of cold-insulating container 1 for use in the methods of delivering frozen products described in the first and second exemplary embodiments.

Cold-insulating container 1 is a collapsible cold-insulating container formed into a box in use and collapsible not in use.

Cold-insulating container 1, as shown in FIG. 3, is formed of four peripheral walls 10, 10, 13, and 13 connected in a square shape to be foldable each other, two lids 16 and 16 connected to two facing peripheral walls 10 and 10 along upper side edges 11 to be foldable, and two bottom faces 21 and 21 connected to two peripheral walls 10 and 10 that are connected to lids 16 and 16, along lower side edges 12 and 12 to be foldable.

In this exemplary embodiment, the length from lid 16 to facing lid 16, i.e. length L from upper side edge 11 of peripheral wall 10 to side edge 17 of lid 16, is substantially a half of width D of peripheral wall 13. Two lids 16 and 16 are identical in shape. Two bottom faces 21 and 21 are also identical in shape to two lids 16. Length L of lid 16 is smaller than height H of peripheral walls 10.

Specifically, as shown in FIG. 3, cold-insulating container 1 for use in this exemplary embodiment measures 600 mm in width, 400 mm in depth, and 300 mm in height H. Length L of lid 16 is approx. 200 mm, which is shorter than height H. Cold-insulating container 1 has an internal capacity of approx. 70 l.

As shown in FIG. 4, each of peripheral walls 10, lids 16, and bottom faces 21 is structured of sheet material 30 enveloping planar vacuum heat-insulating material 31 therein.

As shown in FIG. 4, vacuum heat-insulating material 31 is a heat-insulating material structured by enveloping core material 32 formed of at least one kind of materials selected from fiber materials, resin foamed materials, and granular materials, in gas-barrier jacket material 33 and depressurizing the inside thereof for vacuum encapsulation.

In this exemplary embodiment, a laminate film formed by laminating a heat-weld layer and protective layer inside and outside of a gas-barrier layer, respectively, is used as jacket material 33. In other words, jacket material 33 includes a metal foil made of aluminum or another metal, or a film having a metal or a non-oxide deposited thereon, as a gas-barrier layer. Onto the inner surface of the gas-barrier layer, a film made of non-oriented polypropylene or the like is laminated, as a heat-weld layer. Onto the external surface of the gas-barrier layer, a film made of nylon, polyethylene terephthalate or the like is laminated, as a protective layer.

Used as core material 32 is a material made by heat-forming fiber materials using a binder.

Used in this exemplary embodiment is vacuum heat-insulating material 31 that is structured as above and has an (initial) thermal conductivity of 0.005 W/mK and a thickness of 10 mm. This material can ensure high heat-insulating property in peripheral walls 10, lids 16, and bottom faces 21, and reduce the thickness of respective members.

Sheet material 30 is shaped by sewing a polyester cloth having synthetic resin coating on the backside thereof, and provided of high water resistance, moisture resistance, and flexibility.

In this exemplary embodiment, as shown in FIG. 4, sheet material 30*a* 4 mm thick is used for the faces facing to the outside in use or not in use of cold-insulating container 1, among peripheral walls 10, lids 16, and bottom faces 21. For the other faces, sheet material 30*b* 2 mm thick is used.

In other words, each member of peripheral walls 10, lids 16, bottom faces 21 of cold-insulating container 1 is structured so that sheet material 30 sewn into a bag shape having high water resistance, moisture resistance, and flexibility envelops vacuum heat-insulating material 31 therein. Each of these peripheral walls 10, lids 16, and bottom faces 21 is connected along the side edges of respective ones of sheet material 30 by sewing so as to be foldable.

As shown in FIG. 3, in each of two peripheral walls 13 and 13 adjacent to peripheral walls 10 and 10 connected to lids 16 and bottom faces 21, the vacuum heat-insulating material is divided along folding line 23 extending in the direction of the height thereof so that peripheral walls 13 are foldable along folding lines 23. In other words, each peripheral wall 13 houses two pieces of vacuum heat-insulating materials 31 and 31, and is formed by sewing sheet material 30 along folding line 23 so as to be foldable along folding line 23.

As shown in FIGS. 3 and 5, flexible engaging flap 18 having hook-and-loop fastener 18*a* along side edge 17 is provided on one of lids 16. On the other lid 16, hook-and-loop fastener 20 is provided to correspond with engaging flap 18 on the one of lids 16. Sheet material 30*b* described above (2 mm thick, see FIG. 4) is also used for engaging flap 18. Engaging flap 18 is made by sewing hook-and-loop fastener 18*a* onto sheet material 30*b*.

As shown in FIGS. 3 and 5, flexible engaging flap 24 having hook-and-loop 24*a* is sewn onto each of two foldable peripheral walls 13 along upper side edge 14 so as to be urged substantially upwardly. For engaging flap 24, sheet material 30*b* described above (2 mm thick, see FIG. 4) is also used. Engaging flap 24 is formed by sewing hook-and-loop fastener 24*a* onto sheet material 30*b*.

On the inner surfaces of two lids 16 and 16, hook-and-loop fasteners 19 and 19 are provided so as to correspond with hook-and-loop fasteners 24*a*.

Bottom faces 21 have a basic structure identical with that of lids 16. In other words, as shown in FIGS. 3 and 8, on one of bottom faces 21, flexible engaging flap 22 having hook-and-loop fastener 22*a* is provided along side edge 29. On the other bottom face 21, hook-and-loop fastener 28 is provided so as to correspond with engaging flap 22 on the one of bottom faces 21. For engaging flap 22, sheet material 30*b* described above (2 mm thick, see FIG. 4) is also used. Engaging flap 22 is formed by sewing hook-and-loop fastener 22*a* onto sheet material 30*b*.

As shown in FIGS. 3 and 8, on the external surfaces of bottom faces 21, flexible bottom face sheet 27 is provided to cover the entire surface of the external surface. In other words, bottom face sheet 27 is a rectangle sheet having an outside dimension substantially equal to that of two bottom faces 21. The bottom face sheet is attached by sewing four sides thereof on lower side edges 12 and 15 of peripheral walls 10 and 13. In this exemplary embodiment, sheet material 30*b* described above (2 mm thick, see FIG. 4) is also used for bottom face sheet 27.

Inner cover 25 is provided inside of cold-insulating container 1. Inner cover 25 is made of a flexible square sheet material. As shown in FIGS. 3 and 7, one side of the square sheet is sewn onto upper side edge 11 of peripheral wall 10 connected to one of the lids 16. Inner cover 25 is a shielding material for assisting the shielding property of lids 16.

In this exemplary embodiment, as shown in FIG. 3, inner cover 25 has a width substantially equal to width W of cold-insulating container 1. The length thereof is at least the sum of length D from peripheral wall 10 to facing peripheral wall 10 and height H of peripheral wall 10 or larger, as shown in FIG. 7. Setting inner cover 25 to these dimensions allows inner cover 25 to cover frozen products S1 through S4 completely, even when a gap is generated partly inside of cold-insulating container 1 as shown in FIG. 7. This structure improves the shielding effect.

Inside of cold-insulating container 1, cold-storage agent holder 26 for holding a cold-storage agent is provided. Cold-storage agent holder 26 is a bag formed by a mesh-like net material, as shown in FIGS. 3 and 7. As shown in FIG. 7, cold-storage agent 34 can be held inside thereof. In this exemplary embodiment, cold-storage agent holder 26 is provided on the inner surface of peripheral wall 10 connected to inner cover 25. This structure allows frozen products S1 through S4 to easily be covered with inner cover 25, thus improving cold-insulating performance and shielding property for frozen products S1 through S4.

Incidentally, cold-storage agent holder 26 can be provided not only on the inner surface of peripheral wall 10, but also on the inner surfaces of peripheral walls 13 and lids 16 in a plurality of positions.

In this exemplary embodiment, two pieces of cold-storage agent 34 having a melting point ranging from −27 to −18° C. and a weight of 1 kg can be held in cold-storage agent holder 26. Cold-storage agent 34 used in this exemplary embodiment is "CAH-1001 of −25° C. grade" made by Inoac Corporation.

Next, a description is provided of a method of assembling cold-insulating container 1 of this exemplary embodiment prior to use.

First, as shown in FIG. 8, bottom faces 21 and 21 are turned into a closed position (horizontally) to match side edges 29 and 29 each other, as shown in FIG. 7. Then, pressing engaging flap 22 provided on one of bottom faces 21 onto the other bottom face 21 to engage hook-and-loop fastener 22*a* on engaging flap 22 with hook-and-loop fastener 28 on the other bottom face 21.

When bottom faces 21 and 21 are engaged with each other, a substantially planar surface is formed by both bottom faces 21, and bottom face sheet 27 is positioned under bottom faces 21 and 21 to cover the entire surface as shown in FIG. 7. Thus, bottom face sheet 27 blocks communication between the inside and outside of the cold-insulating container even when a slight gap is generated between bottom faces 21 and peripheral walls. As a result, the cold-insulating property is not affected.

In this exemplary embodiment, water-resistant and moisture-resistant sheet 30*b* is used for bottom face sheet 27. This structure prevents water retained inside of the container from flowing out.

Next, as shown in FIG. 7, cold-storage agent 34 described above is housed in cold-storage agent holder 26 as necessary together with frozen products S1 through S4 to be delivered, such as frozen food, and inner cover 25 is placed to cover frozen products S1 through S4.

In the present invention, cold-storage agent 34 having a melting point ranging from −27 to −18° C. (inclusive) is used. In general wholesalers or distribution centers where small cargo deliveries are performed, the freezers thereof are often controlled at temperatures ranging from −30 to −22° C. (inclusive). For this reason, cold-storage agent 34 having a melting point in the above range is used so as to be solidified only by placement thereof in the freezers. Thus, a cold-storage agent stored and solidified in the freezer can immediately be housed in cold-insulating container 1 available for cold insulation.

After all the frozen products S1 through S4 are housed, lids 16 and 16 are turned into a closed position (in substantially a horizontal direction). Turning lids 16 and 16 inwardly as shown in FIG. 5 inwardly tilts engaging flaps 24 provided on peripheral walls 13 in a substantially upward direction, and engages hook-and-loop fasteners 24*a* on engaging flaps 24 with hook-and-loop fasteners 19 on lids 16. Then, moving lids 16 and 16 into a closed position engages the entire surface of hook-and-loop fasteners 24*a* on engaging flaps 24 with hook-and-loop fasteners 19 on lids 16. Thus, the gaps between lids 16 and peripheral walls 13 are shielded with engaging flaps 24.

Turning lids 16 and 16 into a closed position matches the side edges 17 and 17 each other as shown in FIG. 6. At last, depressing engaging flap 18 provided on one of lids 16 onto the other lid 16 to bring hook-and-loop fasteners 18*a* and 20 into engagement with each other. Thus, engaging flap 18 covers the position in which side edges 17 and 17 of lids 16 and 16 match with each other.

Figure 9A:
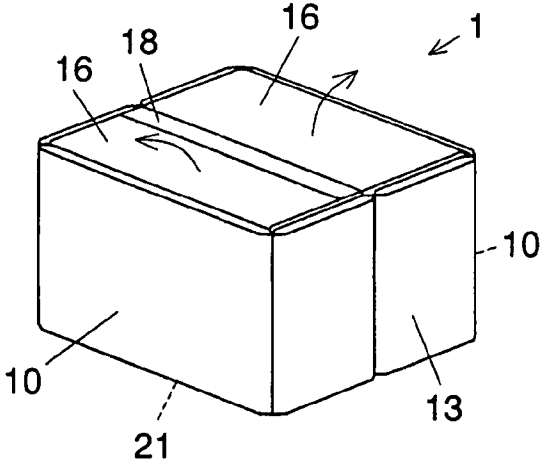
Figure 10A:
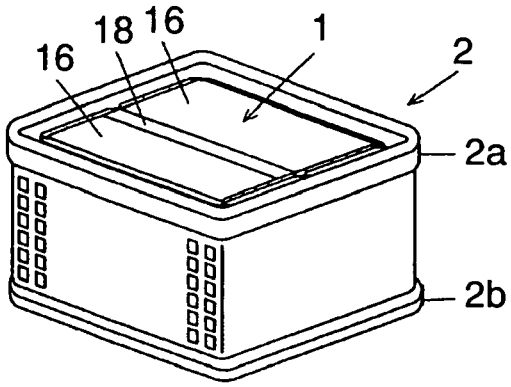
FIG. 10A is a perspective view of illustrating a state in which the cold-insulating container of FIG. 3 is housed in a protective case.
Figure 10B:
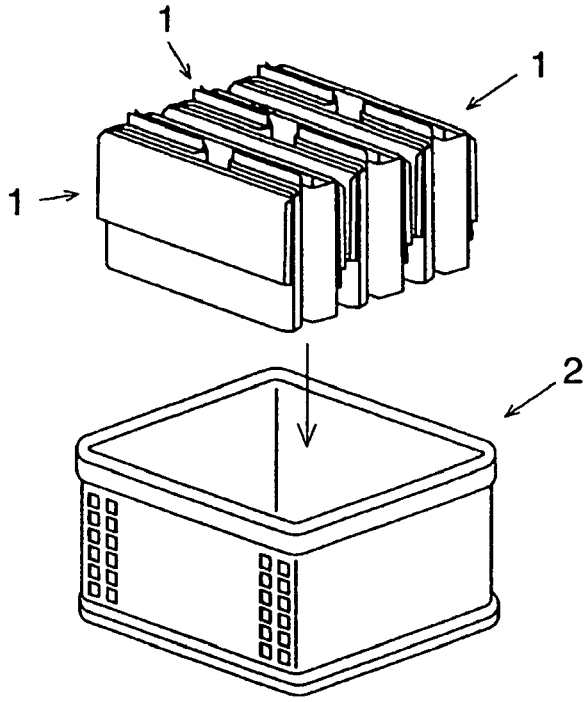
FIGS. 10B and 10C are perspective views illustrating a state in which cold-insulating containers collapsed not in use are housed in the protective case.
Figure 10C:
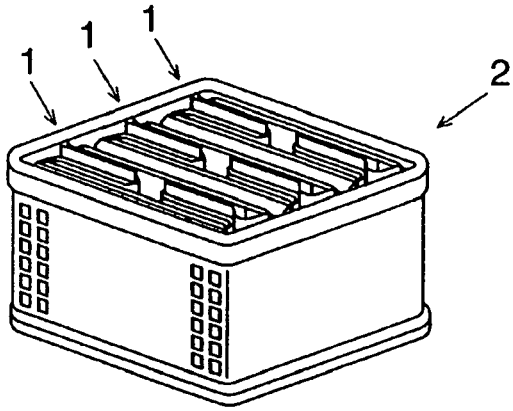
Figure 11A:
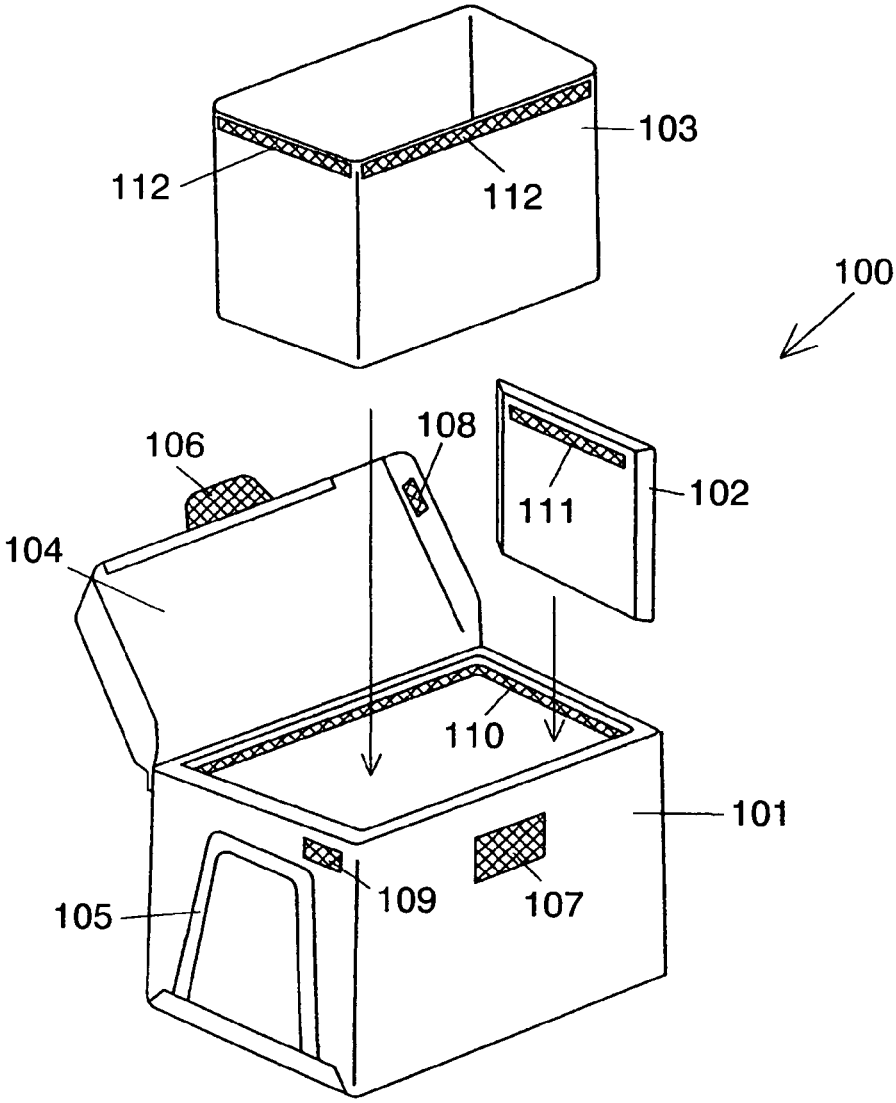
FIGS. 11A and 11B are perspective views showing a conventional cold-insulating container.
Figure 11B:
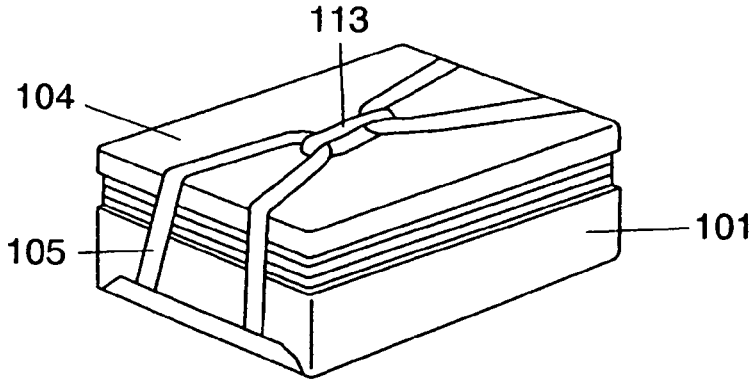

In other words, in cold-insulating container 1 of this exemplary embodiment, only turning bottom faces 21 and 21 and lids 16 and 16 into a closed position to bring engaging flaps 22 and 18 into engagement can form a box surrounded by peripheral walls 10 and 13, bottom faces 21, and lids 16, each enveloping vacuum heat-insulating material 31 therein, as shown FIG. 9A.

In the formed box, as shown FIG. 7, engaging flap 22 covers a position in which side edges 29 and 29 of bottom faces 21 and 21 match with each other, and bottom face sheet 27 covers the external surface of bottom faces 21. Further, as shown FIG. 6, engaging flap 18 covers a position in which lids 16 and 16 match with each other, and engaging flaps 24 shield the gaps between lids 16 and peripheral walls 13.

In this manner, in cold-insulating container 1 of this exemplary embodiment, only moving bottom faces 21 and 21 and lids 16 and 16 into a closed position for assembly can block communication between the inside and outside, and form a highly heat-insulating box with all the faces surrounded by a vacuum heat-insulating material.

In this exemplary embodiment, storing one piece of cold-storage agent (1 kg) having a melting point ranging from −27 to −18° C. (inclusive) per 50 l inside of cold-insulating container 1 can maintain the average temperature of the inside atmosphere of cold-insulating container 1 up to 0° C. continuously for 10 hours or longer. This means that frozen products (e.g. ice cream) can be maintained at temperatures up to approx. −15° C. continuously for 10 hours or longer. Therefore, delivering frozen products in cold-insulating container 1 of this exemplary embodiment using the cold-storage agent can achieve long-distance delivery in which the frozen products are maintained at low temperatures and the quality thereof is not affected.

Next, a description is provided of the procedure for collapsing cold-insulating container 1 not in use.

Cold-insulating containers 1 are collapsed when cold-insulating containers 1 are empty after delivery, or stored at the supplier after being returned, for example.

In the following description of the collapsing procedure, suppose cold-storage agent 34 that has been housed in cold-storage agent holder 26 is taken out.

In the collapsing procedure, first, engaging flaps 24 engaging with lids 16 of cold-insulating container 1 in a box configuration are grasped and pulled up, as shown in FIG. 9A. Then, as shown in FIG. 9B, while engagement of hook-and-loop faster 18*a* on engaging flap 18 and hook-and-loop fastener 20 on lid 16, and engagement of hook-and-loop fasteners 24*a* on engaging flaps 24 and hook-and-loop fasteners 19 on lids 16 are released, lids 16 and 16 are turned into an open position.

Figure 9E:
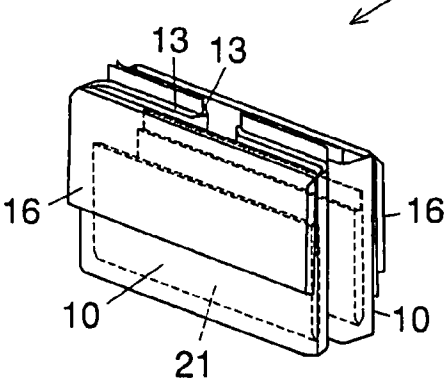
Figure 9D:
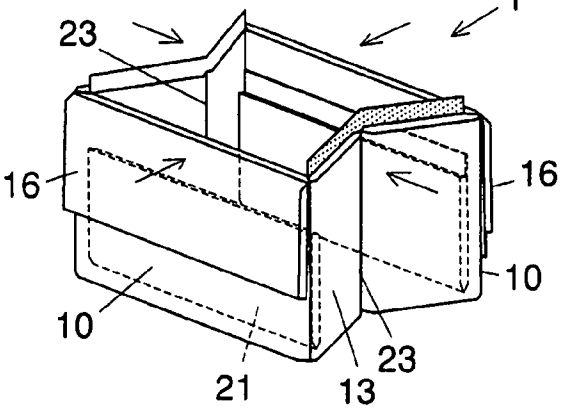
Figure 9C:
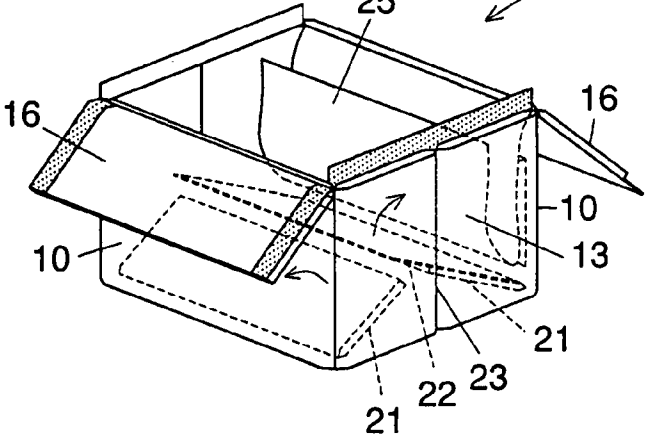

Next, as shown in FIGS. 8 and 9C, inner cover 25 is collected on the side of cold-storage agent holder 26, and engaging flap 22 is grasped and pulled up to release engagement of hook-and-loop fastener 22*a* on engaging flap 22 and hook-and-loop fastener 28 on bottom face 21. Then, as shown in FIG. 9D, bottom faces 21 and 21 are overlapped on the inner surfaces of peripheral walls 10 and 10, and lids 16 and 16 are overlapped on the external surfaces of peripheral walls 10 and 10.

Sequentially, as shown in FIG. 9D, while peripheral walls 13 and 13 are folded inwardly along folding lines 23, peripheral walls 10 and 10 are brought closer to each other. This operation makes two sets of four faces, each made of lid 16, peripheral wall 10, bottom face 21, and folded peripheral wall 13 in order from the outside, overlapping in a symmetric relation with each other. Thus, collapsing operation is completed with eight faces in total overlapping with one another.

In this manner, cold-insulating container 1 of this exemplary embodiment can easily be collapsed into a downsized shape for a short period of time without detachment of heat-insulating panels, which are necessary for a conventional one.

When cold-insulating container 1 is collapsed, as shown in FIG. 9E, eight faces in total, i.e. lids 16 and 16, peripheral walls 10 and 10, bottom faces 21 and 21, and peripheral walls 13 and 13, overlap with one another.

As described above, in this embodiment, length L (200 mm) of lids 16 and bottom faces 21 are smaller than height H (300 mm) of peripheral walls 10 and 13. Thus, collapsing cold-insulating container 1 makes a configuration in which the eight faces overlap with one another with a maximum outside dimension of peripheral wall 10.

In cold-insulating container 1 of FIG. 3, thick sheet material 30*a* of FIG. 4 is used for all the faces facing to the outside in use or not in use. In other words, thick sheet material 30*a* of FIG. 4 is used for the external surfaces of peripheral walls 10, peripheral walls 13, and bottom faces 21, and the inner surfaces and the external surfaces of lids 16.

More specifically, each lid 16 has a thickness of 18 mm, which is the sum of the thickness of vacuum heat-insulating material 31 (10 mm), and the thickness of sheet material 30*a* enveloping vacuum heat-insulating material 31 (4 mm+4 mm). Each of peripheral walls 10 and 13 has a thickness of 16 mm, which is the sum of the thickness of vacuum heat-insulating material 31 (10 mm) and the thickness of sheet materials 30*a* and 30*b* (4 mm+2 mm) enveloping vacuum heat-insulating material 31. Each of bottom faces 21 has a thickness of 16 mm, which is the sum of the thickness of vacuum heat-insulating material 31 (10 mm), and the thickness of sheet materials 30*a* and 30*b* (4 mm+2 mm) enveloping vacuum heat-insulating material 31. Therefore, the eight faces overlapping with one another in a collapsed configuration are approx. 132 mm thick in total.

In other words, collapsing cold-insulating container 1 of this exemplary embodiment provides a scaled-down configuration that has a maximum outside dimension (W600 mm×H300 mm) of the outside dimension of peripheral wall 10 and a thickness of approx. 132 mm. The collapsed configuration is more downsized than the box configuration in use, thus facilitating collection and storage after use.

As described in the exemplary embodiments of the delivery method, when frozen products S are delivered to a destination with the products housed in cold-insulating containers 1, empty cold-insulating containers 1 after use can be collapsed into a downsized shape at the destination for storage. Thus, empty cold-insulating containers 1 do not waste a space at the destination. Especially, cold-insulating containers 1 of this exemplary embodiment can considerably easily be assembled and collapsed for a short period of time, and thus this advantage clears the problem of wasting a space with cold-insulating containers 1 that are left in a box configuration even after use because of troublesome collapsing operation.

Further, cold-insulating container 1 is structured of one member connected so as to be foldable. For this reason, detaching members prior to collapsing operation is unnecessary and thus there is no possibility of missing some of members.

Further, cold-insulating container 1 can be collapsed into a downsized shape. Thus, housing a plurality of collapsed cold-insulating containers 1 in general-purpose roll pallets enables easy transportation thereof.

As described above, thick sheet material 30*a* is used for all the faces facing to the outside in use or not in use.

Thus, in a box configuration in use, thick sheet material 30*a* can protect vacuum heat-insulating material 31 enveloped in each face from external force exerted thereto. In a collapsed configuration not in use, thick sheet material 30*a* protects the inner surfaces of lids 16 from external force exerted thereto. This structure can protect vacuum heat-insulating material 31 from external force in use and not in use, prevent damage to vacuum heat-insulating material 31, and improve the durability thereof.

Now, cold-insulating container 1 of this exemplary embodiment is formed of lids 16, peripheral walls 10 and 13, and bottom faces 21, each enveloping vacuum heat-insulating material 31 therein and having a predetermined strength and rigidity as described above. For this reason, even when cold-insulating container 1 is used by itself, a certain degree of strength and rigidity can be obtained. However, using cold-insulating container 1 in combination with a protective case having a higher strength and rigidity for housing the containers considerably improves the durability of cold-insulating container 1.

For example, as shown in FIG. 10A, protective case 2 capable of completely housing cold-insulating containers 1 therein is prepared and cold-insulating container 1 in a box configuration can be housed in the protective case in combination during delivery.

Protective case 2 as shown in FIG. 10A is made by molding a synthetic resin material, and has a box shape with an open top and a considerably light weight. In protective case 2, the external surfaces of top and bottom parts thereof protrude along all the peripheries to form flange parts 2*a* and 2*b*. Therefore, protective case 2 can easily be carried by using flange part 2*a* as a handhold. Additionally, lids 16 and 16 can be opened and closed by grasping engaging flap 18 while cold-insulating container 1 are housed in protective case 2.

Further, protective cases 2 has an engageable structure so that flange part 2*b* of protective case 2 can be placed on flange part 2*a* of another protective and piled up in a plurality of layers. Therefore, even when a large number of protective cases 2 housing cold-insulating containers 1 are loaded in a delivery vehicle, piling up the cases in a plurality of layers can uses the loading space effectively. Further, cold-insulating containers 1 are not directly under excessive load, and thus are not damaged.

In this manner, the use of cold-insulating containers 1 and lightweight protective cases 2 in combination can considerably improve the durability of cold-insulating containers 1.

Further, as shown in FIG. 9E, cold-insulating container 1 is collapsible into a configuration in which eight faces overlap with one another with a maximum outside dimension of peripheral wall 10. Therefore, a plurality of collapsed cold-insulating containers 1. can be housed in one protective case 2, as shown in FIGS. 10B and 10C.

With this structure, a plurality of cold-insulating containers 1 are grouped and housed in protective case 2 for easy transportation. This structure makes preparing and collecting operations for delivery more efficiently. Additionally, a plurality of cold-insulating containers 1 can be placed in protective case 2 in order for storage, and thus the storage space can be reduced.

In the above description, protective case 2 shown in FIGS. 10A through 10C is formed into a box configuration. However, making protective case 2 into a collapsible structure facilitates transportation of protective case 2 in preparing and collecting operations, thus reducing the storage space.

Collapsible cold-insulating container 1 of the exemplary embodiment can be formed into a box in use and collapsed not in use. In this exemplary embodiment, two pieces of cold-storage agent 34 having a melting point ranging from −27 to −18° C. (inclusive) and a weight of 1 kg may be held in cold-storage agent holder 26. Cold-storage agent 34 used in this exemplary embodiment is "CAH-1001 of −25° C. grade" made by Inoac Corporation.

In this exemplary embodiment, storing one piece of cold-storage agent (1 kg) having a melting point ranging from −27 to −18° C. (inclusive) per 50 l inside of cold-insulating container 1 can maintain the average temperature of the inside atmosphere of cold-insulating container 1 up to 0° C. continuously for 10 hours or longer. This means that frozen products (e.g. ice cream) can be maintained at temperatures up to approx. −15° C. continuously for 10 hours or longer. Therefore, delivering frozen products in cold-insulating container 1 of this exemplary embodiment using cold-storage agent can achieve long-distance delivery in which the frozen products are maintained at low temperatures and the quality thereof is not affected.

In cold-insulating container 1 of FIG. 3, thick sheet material 30*a* of FIG. 4 is used for all the faces facing to the outside in use or not in use. In other words, thick sheet material 30*a* of FIG. 4 can be used for the external surfaces of peripheral walls 10, peripheral walls 13, and bottom faces 21, and the inner surfaces and the external surfaces of lids 16.

More specifically, each lid 16 may have a thickness of 18 mm, which is the sum of the thickness of vacuum heat-insulating material 31 (10 mm) and the thickness of sheet material 30*a* enveloping vacuum heat-insulating material 31 (4 mm+4 mm). Each of peripheral walls 10 and 13 has a thickness of 16 mm, which is the sum of the thickness of vacuum heat-insulating material 31 (10 mm) and the thickness of sheet materials 30*a* and 30*b* (4 mm+2 mm) enveloping vacuum heat-insulating material. Each of bottom faces 21 may have a thickness of 16 mm, which is the sum of the thickness of vacuum heat-insulating material 31 (10 mm) and the thickness of sheet materials 30*a* and 30*b* (4 mm+2 mm) enveloping the vacuum heat-insulating material. Therefore, the eight faces overlapping with one another in a collapsed configuration are approx. 132 mm thick in total.

In other words, collapsing cold-insulating container 1 of this exemplary embodiment provides a scaled-down configuration having a maximum outside dimension (W600 mm×H300 mm) of the outside dimension of peripheral wall 10 and a thickness of approx. 132 mm. The collapsed configuration is more downsized than the box configuration in use. Thus, housing a plurality of collapsed cold-insulating containers 1 in general-purpose roll pallets enables easy transportation thereof.

INDUSTRIAL APPLICABILITY

A method of delivering frozen products of the present invention allows frozen products to be delivered in cold-insulating containers having considerably high cold-insulating performance by a delivery vehicle other than a freezer vehicle. Thus, the delivery method can be used for delivery operation using delivery media other than a delivery vehicle, such as a railway and airplane. Because a collapsible cold-insulating container of the present invention has excellent cold-insulating performance, and can easily be collapsed for easy collection and storage not in use, it is suitable for applications, such as cold-insulating transportation of frozen products.

The invention claimed is:

1. A method of delivering frozen products comprising:

storing frozen products in a cold-insulating container;

the cold-insulating container comprising:

a collapsible cold-insulating container comprising four peripheral walls, a bottom face, and a flexible rectangle bottom face sheet, the container being collapsible with the four peripheral walls, the bottom face, and the bottom face sheet remaining connected with each other, wherein the four peripheral walls are connected into a square shape so as to be foldable relative to one another, the bottom face is connected to the peripheral walls along a lower side edge of at least one of the peripheral walls, the bottom face being rotatable around the lower side edge toward an inside of the container, the bottom face is formed enveloping a vacuum heat-insulating material therein, two of the peripheral walls on opposing sides of the container each have a folding line extending from an upper side edge to a lower side edge thereof, each folding line being located at a middle of the respective peripheral wall, each of the peripheral walls having the folding line also including two vacuum heat insulators, the insulators being separated along the folding line, respective halves of the peripheral wall on each side of the folding line being rotatable around the folding line such that the folding line moves toward the inside of the container, the bottom face sheet is attached to the four peripheral walls along lower side edges of the walls, so as to cover an entire outer surface of the bottom face, when the bottom face is rotated into a close position to form the box, and the container has a collapsed state, in which the bottom face is rotated inward around the lower side edge and positioned approximately parallel with and between two opposing peripheral walls not having the folding lines, and the halves of the two of the peripheral walls having the folding lines are rotated around the folding lines such that the two peripheral walls are folded approximately in half, with each half positioned approximately parallel with and between the two opposing peripheral walls not having the folding lines; and loading the cold-insulating container in a vehicle that is maintained at a temperature higher than a freezing temperature of the frozen products.

2. The method of delivering frozen products of claim 1, wherein the cold-insulating container includes a plurality of individual cold-insulating panels, each of the panels including a heat insulating material that is structured so that a core material made by compression-molding a fiber material is covered with a gas-barrier jacket material, and an inside covered with the jacket material is depressurized for vacuum encapsulation.

3. The method of delivering frozen products of claim 1, wherein the cold-insulating container includes a plurality of individual cold-insulating panels, each of the panels including a heat insulating material has a thickness ranging from 2 to 20 mm inclusive.

4. The method of delivering frozen products of claim 1, wherein the cold-insulating container includes a plurality of individual cold-insulating panels, each of the panels including a heat insulating material has an initial thermal conductivity up to 0.01 W/mK.

5. The method of delivering frozen products of claim 1, wherein the cold-insulating container is capable of housing frozen products at least at a predetermined percentage with respect to an internal capacity thereof, and maintaining an inside temperature thereof up to 0° C. at least for two hours.

6. The method of delivering frozen products of claim 1, wherein a cold-storage agent is housed in the cold-insulating container in an amount according to time taken for delivery.

7. The method of delivering frozen products of claim 1, wherein a cold-storage agent having a melting point ranging from −27 to −18° C. inclusive is housed in the cold-insulating container.

8. The method of delivering frozen products of claim 1, wherein the cold-insulating container is capable of housing at least 1 kg of the cold storage agent per internal capacity of 50 l, and maintaining an average inside temperature up to 0° C. for at least 10 hours.

9. The method of delivering frozen products of claim 1, wherein the cold-insulating container has an internal capacity of at least 70 l.

10. The method of delivering frozen products of claim 1, wherein a protective case for housing the cold-insulating container is provided, and the frozen products are delivered while the cold-insulating container is housed in the protective case.

11. A collapsible cold-insulating container comprising four peripheral walls, a bottom face, and a flexible rectangle bottom face sheet, the container being collapsible with the four peripheral walls, the bottom face, and the bottom face sheet remaining connected with each other, wherein the four peripheral walls are connected into a square shape so as to be foldable relative to one another, the bottom face is connected to the peripheral walls along a lower side edge of at least one of the peripheral walls, the bottom face being rotatable around the lower side edge toward an inside of the container, the bottom face is formed with a vacuum heat-insulating material enveloped therein, two of the peripheral walls on opposing sides of the container each have a folding line extending from an upper side edge to a lower side edge thereof, each folding line being located at a middle of the respective peripheral wall, each of the peripheral walls having the folding line also including two vacuum heat insulators, the insulators being separated along the folding line, respective halves of the peripheral wall on each side of the folding line being rotatable around the folding line such that the folding line moves toward the inside of the container, the bottom face sheet is attached to the four peripheral walls along lower side edges of the peripheral walls, so as to cover an entire outer surface of the bottom face, when the bottom face is rotated into a close position to form the box, and the container has a collapsed state, in which the bottom face is rotated inward around the lower side edge and positioned approximately parallel with and between two opposing peripheral walls not having the folding lines, and the halves of the two of the peripheral walls having the folding lines are rotated around the folding lines such that the two peripheral walls are folded approximately in half, with each half positioned approximately parallel with and between the two opposing peripheral walls not having the folding lines.

12. A collapsible cold-insulating container comprising four peripheral walls, two bottom faces, and a flexible rectangle bottom face sheet, the container being collapsible with the four peripheral walls, the bottom faces, and the bottom face sheet remaining connected with each other, wherein the four peripheral walls are connected into a square shape so as to be foldable relative to one another, the two bottom faces are connected to two opposite peripheral walls along lower side edges of the two opposite peripheral walls, the bottom faces being rotatable around the lower sides edges toward an inside of the container, the bottom face is formed with a vacuum heat-insulating material enveloped therein, two of the peripheral walls on opposing sides of the container each have a folding line extending from an upper side edge to a lower side edge thereof, each folding line being located at a middle of the respective peripheral wall, each of the peripheral walls having the folding line also including two vacuum heat insulators, the insulators being separated along the folding line, respective halves of the peripheral wall on each side of the folding line being rotatable around the folding line such that the folding line moves toward the inside of the container, the bottom face sheet is attached to the four peripheral walls along lower side edges of the walls, so as to cover an entire outer surface of the two bottom faces, when the two bottom faces are rotated into a close position to form the box, and the container has a collapsed state, in which the bottom faces are rotated inward around the lower side edges and positioned approximately parallel with and between two opposing peripheral walls not having the folding lines, and the halves of the two of the peripheral walls having the folding lines are rotated around the folding lines such that the two peripheral walls are folded approximately in half, with each half positioned approximately parallel with and between the two opposing peripheral walls not having the folding lines.

13. The cold-insulating container of claim 12 further comprising:

a flexible engaging flap including hook-and-loop fastener disposed along a side edge of one of the bottom faces engaging with another bottom face, and a hook-and-loop fastener disposed on the another bottom face at a portion corresponding to the engaging flap, wherein turning the two bottom faces into a closed position matches side edges of both bottom faces and brings the engaging flap on the one bottom face into contact with the another bottom face to engage both hook-and-loop fasteners with each other.

14. The cold-insulating container of claim 12, wherein two opposite peripheral walls adjacent to the peripheral walls connected to the bottom faces have folding lines extending along height direction at middle portions thereof, and are made foldable along the folding lines, and when the box is collapsed, the bottom faces are folded into inward of the peripheral walls, the foldable walls are folded inwardly along the folding line to make the adjacent peripheral walls to approximate with each other, and the peripheral walls and the bottom face overlap with each other.

15. The cold-insulating container of claim 11, further comprising a foldable lid connected along an upper edge of the peripheral wall adjacent to the foldable peripheral wall that is foldable along the folding line, wherein the container forms a box, and collapses to be overlapped while the lid is connected to the peripheral wall.

16. The cold-insulating container of claim 11, further comprising a foldable two lids connected along upper edges of the two peripheral walls that are connected to the bottom face, wherein the container forms a box, and collapses to be overlapped while the lids are connected to the peripheral wall.

17. The cold-insulating container of claim 16 further comprising:

a flexible engaging flap including a flexible hook-and-loop fastener disposed along a side edge of one of the lids engaging with another lid; and a hook-and-loop fastener disposed on the another lid at a portion corresponding to the engaging flap, wherein turning the two lids into a closed position matches side edges of both lids and brings the engaging flap on the one lid into contact with the other lid to engage both hook-and-loop fasteners each other.

18. The cold-insulating container of claim 16 further comprising:

a flexible engaging flap including a hook-and-loop fastener disposed along an upper side edge of each of the two foldable peripheral walls so that the engaging flap is urged upwardly rather than laterally; and a hook-and-loop fastener disposed on each of the two lids at a portion corresponding to the hook-and-loop fastener on the engaging flap, wherein, when the two lids are turned into a closed position, the lids depress the engaging flaps and make contact therewith so that the hook-and-loop fasteners and corresponding ones engage with each other.

19. The cold-insulating container of claim 14 wherein the lid is formed with vacuum heat-insulating material enveloped therein.

20. The cold-insulating container of claim 11 wherein the four peripheral walls are formed with vacuum heat-insulating material enveloped therein.

21. The cold-insulating container of claim 11 wherein the bottom face sheet is made of water-proof materials.

22. The cold-insulating container of claim 13, wherein two opposite peripheral walls adjacent to the peripheral walls connected to the bottom faces have folding lines extending along height direction at middle portions thereof, and are made foldable along the folding lines, and when the box is collapsed, the bottom faces are folded into inward of the peripheral walls, the foldable walls are folded inwardly along the folding line to make the adjacent peripheral walls to approximate with each other, and the peripheral walls and the bottom face overlap with each other.

23. The cold-insulating container of claim 17 further comprising:

a flexible engaging flap including a hook-and-loop fastener disposed along an upper side edge of each of the two foldable peripheral walls so that the engaging flap is urged upwardly rather than laterally; and a hook-and-loop fastener disposed on each of the two lids at a portion corresponding to the hook-and-loop fastener on the engaging flap, wherein, when the two lids are turned into a closed position, the lids depress the engaging flaps and make contact therewith so that the hook-and-loop fasteners and corresponding ones engage with each other.

* * * * *